US008985731B2

(12) United States Patent
Shimizu et al.

(10) Patent No.: US 8,985,731 B2
(45) Date of Patent: Mar. 24, 2015

(54) LIQUID EJECTION APPARATUSES

(71) Applicants: Seiji Shimizu, Ogaki (JP); Yoshihumi Suzuki, Ena (JP); Atsushi Hirota, Nagoya (JP)

(72) Inventors: Seiji Shimizu, Ogaki (JP); Yoshihumi Suzuki, Ena (JP); Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 5 days.

(21) Appl. No.: 13/852,827

(22) Filed: Mar. 28, 2013

(65) Prior Publication Data

US 2013/0307895 A1 Nov. 21, 2013

(30) Foreign Application Priority Data

May 18, 2012 (JP) ..... 2012-114863
May 18, 2012 (JP) ..... 2012-114864

(51) Int. Cl.
*B41J 2/165* (2006.01)
*B41J 2/045* (2006.01)
*B41J 2/155* (2006.01)

(52) U.S. Cl.
CPC ..... *B41J 2/04566* (2013.01); *B41J 2/155* (2013.01); *B41J 2/16552* (2013.01); *B41J 2002/16555* (2013.01)
USPC ..... 347/17; 347/29; 347/22; 347/25

(58) Field of Classification Search
USPC ..... 347/17, 25, 29, 20, 22, 30, 31
See application file for complete search history.

(56) References Cited

U.S. PATENT DOCUMENTS

| | | | | |
|---|---|---|---|---|
| 4,223,324 | A * | 9/1980 | Yamamori et al. | 347/21 |
| 2004/0189744 | A1* | 9/2004 | Myhill et al. | 347/34 |
| 2008/0233860 | A1* | 9/2008 | Perry | 454/238 |
| 2011/0109690 | A1* | 5/2011 | Kida et al. | 347/25 |
| 2011/0242204 | A1* | 10/2011 | Shinoda | 347/29 |

FOREIGN PATENT DOCUMENTS

| | | | |
|---|---|---|---|
| JP | 2000-079696 | A | 3/2000 |
| JP | 2005-271316 | A | 10/2005 |
| JP | 2006-062166 | A | 3/2006 |
| JP | 2011-098522 | A | 5/2011 |
| JP | 2011-207091 | A | 10/2011 |

* cited by examiner

*Primary Examiner* — Geoffrey Mruk
*Assistant Examiner* — Scott A Richmond
(74) *Attorney, Agent, or Firm* — Baker Botts L.L.P.

(57) ABSTRACT

A liquid ejection apparatus includes feeding mechanism that feeds a recording medium in a first direction, a head including nozzles that eject liquid; and a humidifying mechanism. The humidifying mechanism includes a humidified air generating device that generates humidified air, an output portion that outputs the humidified air generated by the humidified air generating device, and a receiving portion that receives the humidified air output from the output portion. The output portion includes a first opening and a second opening. An area of the second opening is greater than an area of the first opening, and the first opening is separated from the second opening in a second direction perpendicular to the first direction. The head is disposed between the output portion and the receiving portion in the first direction.

27 Claims, 15 Drawing Sheets

LIQUID EJECTION APPARATUSES

CROSS-REFERENCE TO RELATED APPLICATION

This application claims priority from Japanese Patent Application Nos. 2012-114863 and 2012-114864 filed on May 18, 2012, which are incorporated herein by reference.

BACKGROUND OF THE INVENTION

1. Field of the Invention

The invention relates generally to a liquid ejection apparatus configured to eject liquid.

2. Description of Related Art

A known liquid ejection apparatus includes a humidifying mechanism configured to humidify an enclosed space, e.g., an ejection area, opposite to nozzles of a head, after the ejection area is covered (e.g., after a capping operation) when the head is not used or not operated. The humidifying maintenance is performed such that the air in the ejection area is discharged from an air discharge opening disposed at an end of the head in its longitudinal direction and the humidified air is supplied to the ejection area from an air supply opening disposed at an opposite end of the head in its longitudinal direction.

In the known liquid ejection apparatus, the air discharge opening and the air supply opening are disposed at positions to interpose the head therebetween in the longitudinal direction of the head. Therefore, the humidified air supplied from the air supply opening flows or moves in a relatively long distance in the longitudinal direction of the head and is discharged from the air discharge opening. The humidified air supplies moisture to liquid adjacent to the nozzles sequentially from the nozzles disposed on a side closer to the air supply opening, to the nozzles disposed on a side closer to the air discharge opening. Therefore, the humidity of the humidified air becomes lower as the humidified air further moves toward the air discharge opening. The decrease in the humidity of the humidified air becomes more significant as a moving distance of the humidified air becomes longer. The significant difference with respect to the drying of liquid may occur between the nozzles disposed on the side closer to the air supply opening and the nozzles disposed on the side closer to the air discharge opening.

SUMMARY OF THE INVENTION

Aspects of the invention relate to a liquid ejection apparatus in which variances in the drying of nozzles may be reduced and liquid consumption may be reduced.

According to an embodiment of the invention, a liquid ejection apparatus comprising: a feeding mechanism configured to feed a recording medium in a first direction; a head comprising a nozzle surface in which nozzles are disposed, wherein the head is configured to eject liquid through the nozzles; and a humidifying mechanism comprising: a humidified air generating device configured to generate humidified air; an output portion connected to the humidified air generating device and configured to output the humidified air generated by the humidified air generating device, wherein the output portion comprises a first opening and a second opening, wherein an area of the second opening is greater than an area of the first opening, and the first opening is separated from the second opening in a second direction perpendicular to the first direction; and a receiving portion configured to receive the humidified air output from the output portion, wherein the head is disposed between the output portion and the receiving portion in the first direction.

According to another embodiment of the invention, a liquid ejection apparatus comprising: a feeding mechanism configured to feed a recording medium in a first direction; a head comprising a nozzle surface in which nozzles are disposed, wherein the head is configured to eject liquid through the nozzles; and a humidifying mechanism comprising: a humidified air generating device configured to generate humidified air; an output portion connected to the humidified air generating device and configured to output the humidified air generated by the humidified air generating device, wherein the output portion comprises an opening facing a direction toward a portion of the feeding mechanism and inclined toward the nozzle surface of the head; and a receiving portion is configured to receive the humidified air output from the output portion, wherein the head is disposed between the output portion and the receiving portion in the first direction.

According to still another embodiment of the invention, a liquid ejection apparatus comprising: a feeding mechanism configured to feed a recording medium in a first direction; a head comprising a nozzle surface in which nozzles are disposed, wherein the head is configured to eject liquid through the nozzles; and a humidifying mechanism comprising: a humidified air generating device configured to generate humidified air, an output portion connected to the humidified air generating device and disposed at an upstream side surface of the head in the feeding direction, wherein the output portion is configured to output humidified air generated by the humidified air generating device; and a receiving portion disposed at a downstream side surface of the head in the feeding direction, wherein the receiving portion is configured to receive humidified air output from the output portion.

According to yet another embodiment of the invention, a liquid ejection apparatus comprising: a feeding mechanism configured to feed a recording medium in a first direction; a head comprising a nozzle surface in which nozzles are disposed, wherein the head is configured to eject liquid through the nozzles; and a humidifying mechanism comprising: a humidified air generating device configured to generate humidified air; an output portion connected to the humidified air generating device and configured to output the humidified air generated by the humidified air generating device through a plurality of openings, such that each of the plurality of openings supplies a same flow amount of the humidified air, and a receiving portion configured to receive the humidified air output from the output portion, wherein the head is disposed between the output portion and the receiving portion.

According to still yet another embodiment of the invention, a liquid ejection apparatus comprising: a feeding mechanism configured to feed a recording medium in a first direction; a head comprising a nozzle surface in which nozzles are disposed, wherein the head is configured to eject liquid through the nozzles; a capping mechanism comprising a cover configured to cover a portion of the nozzle surface, such that an enclosed space is formed between the cover and the nozzle surface when the cover covers the portion of the nozzle surface; a humidifying mechanism comprising: a humidified air generating device configured to generate humidified air; an output portion disposed upstream from the head in the first direction, connected to the humidified air generating device and configured to output the humidified air generated by the humidified air generating device; and a receiving portion disposed downstream from the head in the first direction and configured to receive the humidified air output from the output portion, wherein the cover is configured to cover the output portion and the receiving portion when the cover covers the portion of the nozzle surface; and a controller configured to control the humidifying mechanism such that the humidifying mechanism performs a humidifying operation when the nozzle surface is not covered by the cover and the nozzles eject liquid and when the nozzle surface is covered by the cover.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Figure 1:
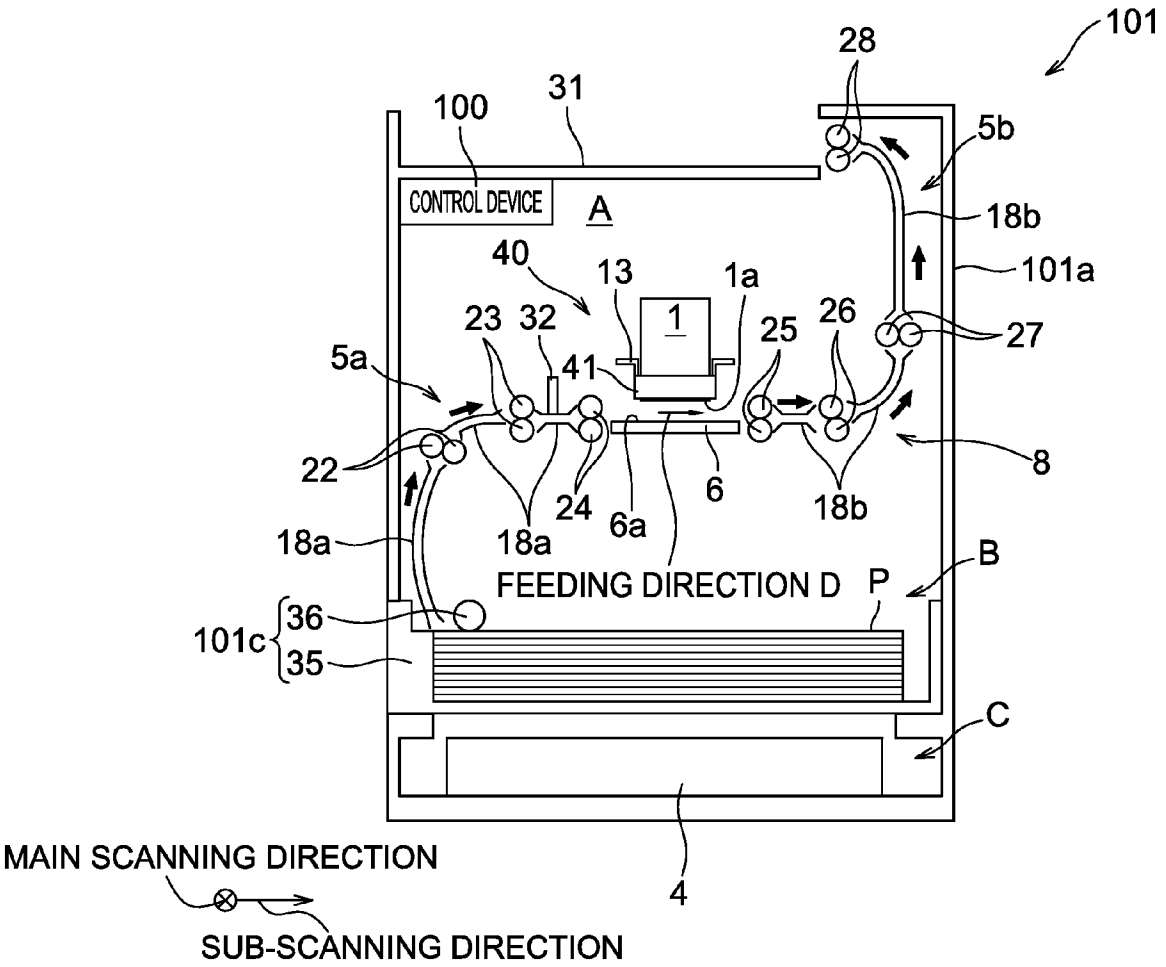
FIG. 1 is a side view showing an internal structure of an inkjet printer according to an embodiment of the invention.

Example embodiments are described in detail herein with reference to the accompanying drawings, like reference numerals being used for like corresponding parts in the various drawings.

As depicted in FIG. 1, a liquid ejection apparatus, e.g., a printer 101, may comprise a casing 101*a* having a rectangular parallelepiped shape. A sheet discharge portion 31 may be provided on a top plate of the casing 101*a*. An inner space of the casing 101*a* may be divided into spaces A, B, and C in order from an upper side thereof. A sheet feeding path extending from a sheet supply portion 101*c* to the sheet discharge portion 31 may be disposed in the spaces A and B. A recording medium, e.g., sheets P, may be fed in a feeding direction, e.g., first direction, as depicted by black arrows in FIG. 1. An image recording process may be performed onto the sheet P in the space A and the sheet P may be fed to the sheet discharge portion 31. In the space B, the sheet may be supplied to the sheet feeding path. Liquid, e.g., ink, may be supplied from the space C to an inkjet head 1 (hereinafter simply referred to as the "head 1") that may be disposed in the space A.

The head 1 configured to eject ink, e.g., black ink, a feeding mechanism 8, a capping mechanism 40, a sheet sensor 32, a humidifying mechanism 50, as depicted in FIG. 4, used for a humidifying operation, and a control device 100 may be disposed in the space A.

Figures 2A, 2B:
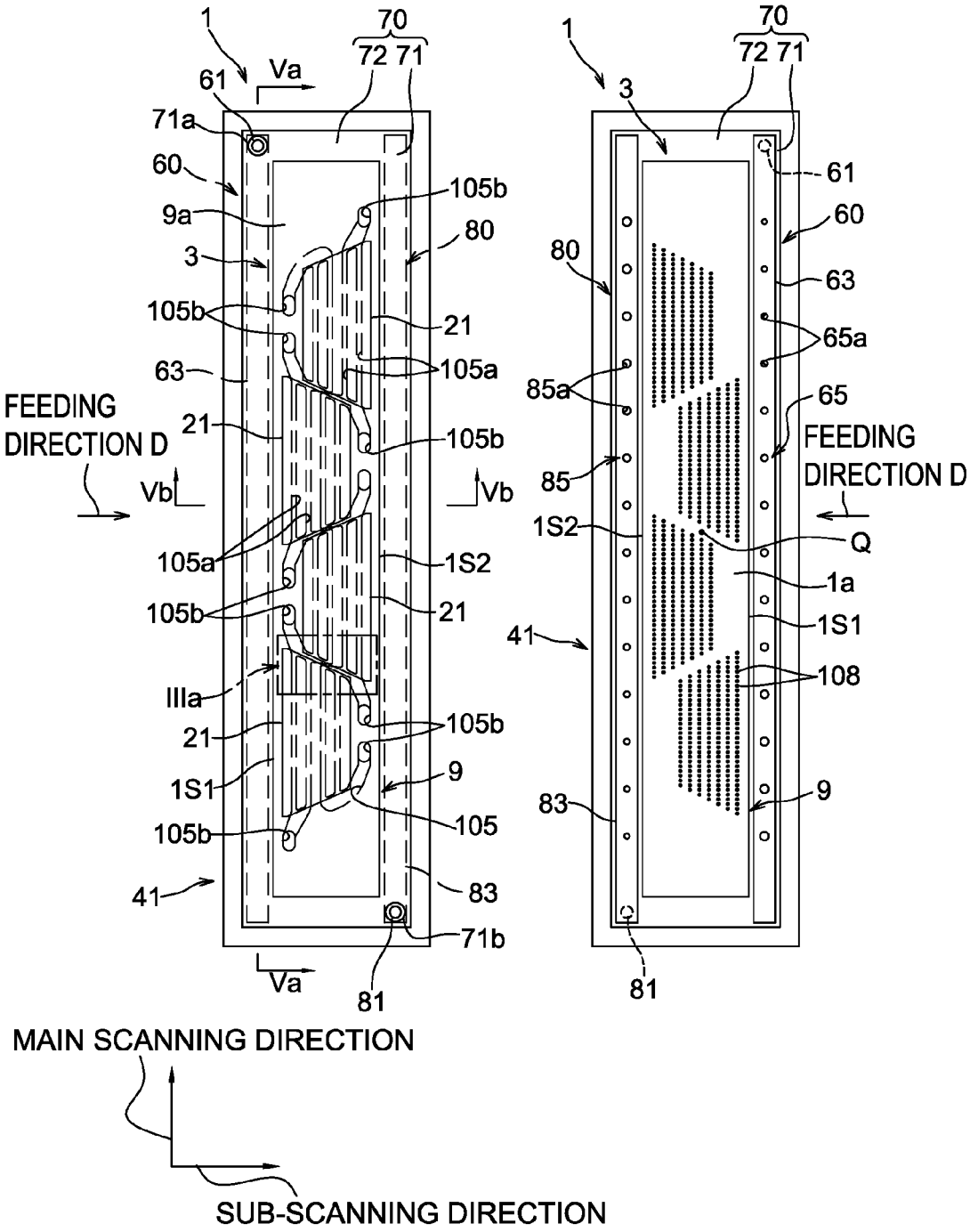
FIG. 2A is a top view of an inkjet head according to an embodiment of the invention.
FIG. 2B is a bottom view of the inkjet head of FIG. 2A according to an embodiment of the invention.

As depicted in FIGS. 2A and 2B, the head 1 may have a rectangular parallelepiped shape elongated in a main scanning direction, e.g., a second direction or a longitudinal direction of the head 1. The main scanning direction may be a direction parallel to a horizontal direction and perpendicular to a sub-scanning direction. The sub-scanning direction may be a direction parallel to a feeding direction D, as indicated by an arrow in FIG. 1, in which the sheet P may be fed by feeding roller pairs 24 and 25. The head 1 may be supported by the casing 101*a*, via a head holder 13, to face an opposing member, e.g., a platen 6, with a predetermined distance between the head 1 and the platen 6. The head 1 may be a stacked body comprising a head body 3, as depicted in FIGS. 2A and 2B, a reservoir unit, a flexible printed circuits board (FPC), and a circuit board. Ink may be supplied from a cartridge 4 to the reservoir unit.

The head body 3 may comprise a flow path unit 9 and an actuator unit 21. Ink in the reservoir unit may be supplied through an ink supply port 105*b* disposed on an upper surface of the flow path unit 9. A lower surface of the flow path unit 9 may comprise a nozzle surface 1*a* having nozzles 108. Ink may be ejected from the nozzles 108 as the actuator unit 21 is driven.

The circuit board may be configured to convert signals received from the control device 100 and to output the signals to the FPC. The signals output from the circuit board may be converted into a driving signal by a driver IC of the FPC and may be output to the actuator unit 21 of the head body 3. As the driving signal is supplied to the actuator unit 21, the actuator unit 21 may deform to apply pressure to the ink in the flow path unit 9.

The head 1 and a dividing member 41 of the capping mechanism 40 may be mounted to the head holder 13. The dividing member 41 may be provided to the head 1. The dividing member 41 may have an annular shape elongated in the main scanning direction, e.g., a longitudinal direction of the dividing member 41. The dividing member 41 may enclose the head 1.

The feeding mechanism 8 may comprise guide portions 5*a* and 5*b* configured to guide the sheet P and the platen 6. The feeding mechanism 8 may constitute the sheet feeding path. The guide portion 5*a* and the guide portion 5*b* may be disposed upstream and downstream of the platen 6, respectively, and the platen 6 may be disposed therebetween in the feeding direction. The guide portion 5*a* may comprise three guides 18*a* and three feeding roller pairs 22-24. The guide portion 5*a* may connect the sheet supply portion 101*c* and the platen 6. The sheet P for image recording may be fed to the platen 6. The guide portion 5*b* may comprise three guides 18*b* and four feeding roller pairs 25-28. The guide portion 5*b* may connect the platen 6 and the sheet discharge portion 31. The sheet P having an image recorded thereon may be fed to the sheet discharge portion 31.

The platen 6 may be configured to support the sheet P from underneath when the sheet P is being fed and an image is recorded on the sheet P. The platen 6 may be a flat plate having a rectangular shape. The platen 6 may be slightly larger than the dividing member 41 in plan view.

The sheet sensor 32 may be disposed upstream of the feed roller pair 24. The sheet sensor 32 may be configured to detect a leading end of the sheet P being fed. A detection signal output from the sensor 32 may be used for synchronizing the operations of the head 1 and the feeding mechanism 8 to record an image at a desired resolution and speed.

Figure 4A:
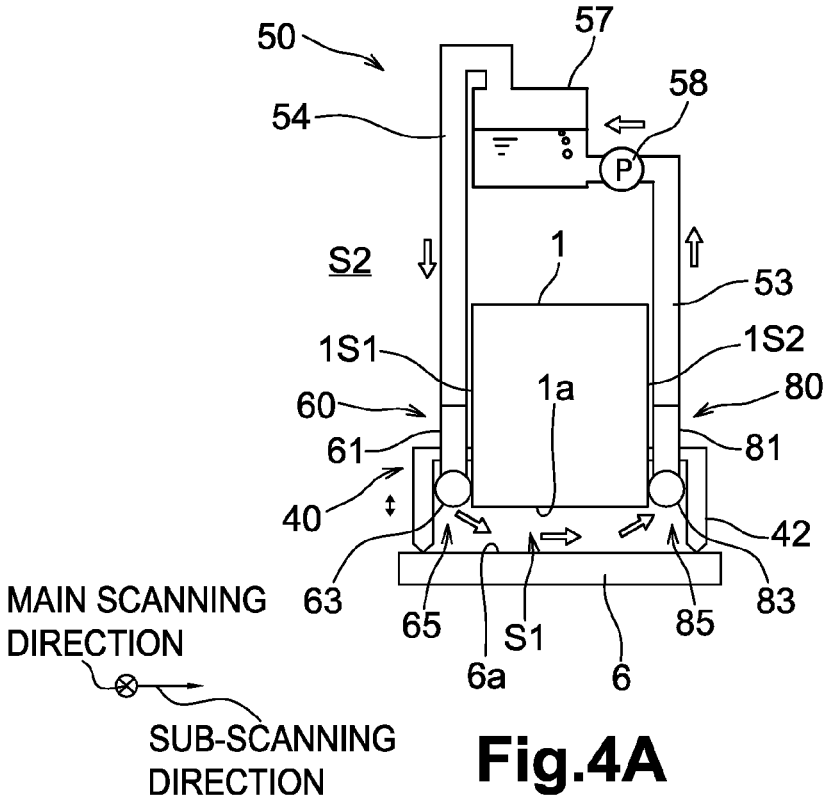
FIG. 4A is a drawing depicting a capping mechanism and a humidifying mechanism of an ink jet printer according to an embodiment of the invention.
Figure 4B:
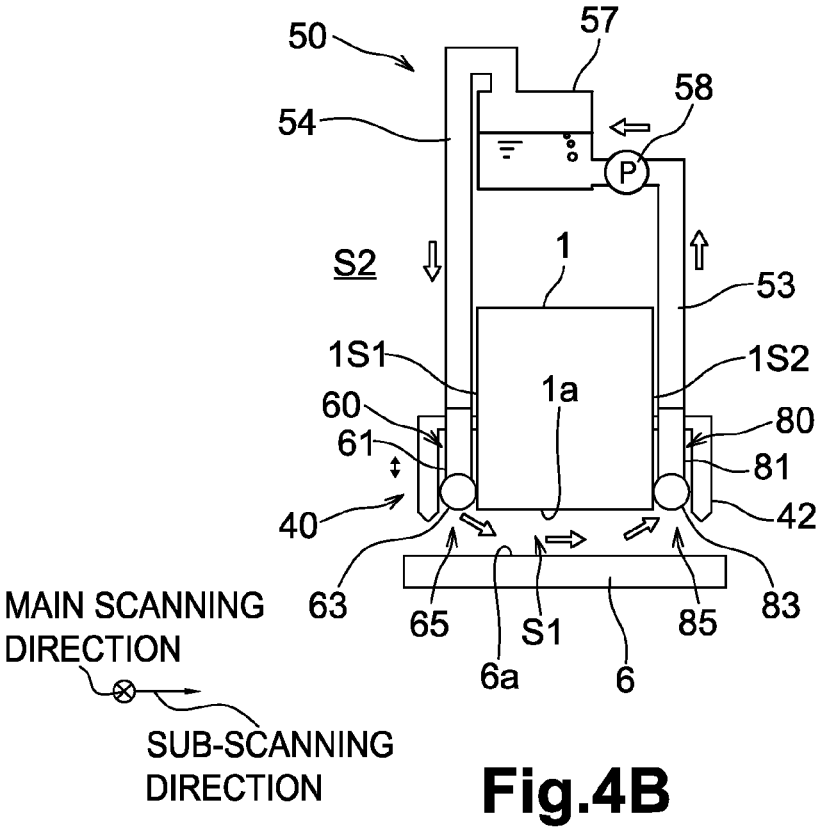
FIG. 4B is another drawing depicting the capping mechanism and the humidifying mechanism of FIG. 4A.

The humidifying mechanism 50 may be configured to supply humidified air to the nozzles 108, which may selectively be capped and uncapped. The humidifying mechanism 50 may comprise a humidified air generating portion, e.g., a humidified air generating device, a humidified air supplying portion, e.g., output portion, and a humidified air discharging portion, e.g., receiving portion. The humidified air generating portion may be configured to generate humidified air and supply the humidified air to the humidified air supplying portion. In response to the supply of the humidified air, the humidified air supplying portion may be configured to humidify the nozzles 108. The humidified air discharging portion may be configured to discharge the air from a portion near the nozzles 108. As depicted in FIGS. 4A and 4B, the humidified air generating portion may comprise tubes 53 and 54, a tank 57, and a pump 58. As depicted in FIGS. 2A and 2B, the humidified air supplying portion may comprise a supply pipe 60. The humidified air discharging portion may comprise a discharge pipe 80. The tank 57 may be a source for generating humidified air. When a humidifying operation is performed, the pump 58 may be driven to supply the humidified air from the supply pipe 60, via the tubes 53 and 54, to a portion near the nozzles 108. The air may be discharged from the discharge pipe 80 via the tube.

As depicted in FIGS. 2B, 4A and 4B, the humidifying mechanism 50 may comprise a supply opening portion 65 and a discharge opening portion 85. The supply opening portion 65 and the discharge opening portion 85 may communicate with an ejection area S1 which may be a space defined between the nozzle surface 1*a* and the platen 6. The nozzles 108 may be disposed between the supply opening portion 65 and the discharge opening portion 85 in the sub-scanning direction, e.g., a lateral direction of the head 1 parallel to a shorter side of the head 1, when viewed in a direction perpendicular to the nozzle surface 1*a*. The supply opening portion 65 may extend in the longitudinal direction of the head 1 along an upstream side surface 1S1 of the head body 3 in the feeding direction D. The discharge opening portion 85 may extend in the longitudinal direction of the head 1 along a downstream side surface 1S2 of the head body 3 in the feeding direction D. The humidifying mechanism 50 may be configured to supply the humidified air to the supply opening portion 65 and discharge the air in a space, e.g., an ejection space S1, to the discharge opening portion 85.

Referring back to FIG. 1, the sheet supply portion 101*c* may be disposed in the space B. The sheet supply portion 101*c* may comprise a sheet supply tray 35 and a pickup roller 36. The sheet supply tray 35 may be configured to be removably inserted into the casing 101*a*. The sheet supply tray 35 may be configured to hold a stack of the sheets P. The pickup roller 36 may be configured to pick up and feed the uppermost sheet P in the sheet supply tray 35.

Figure 11:
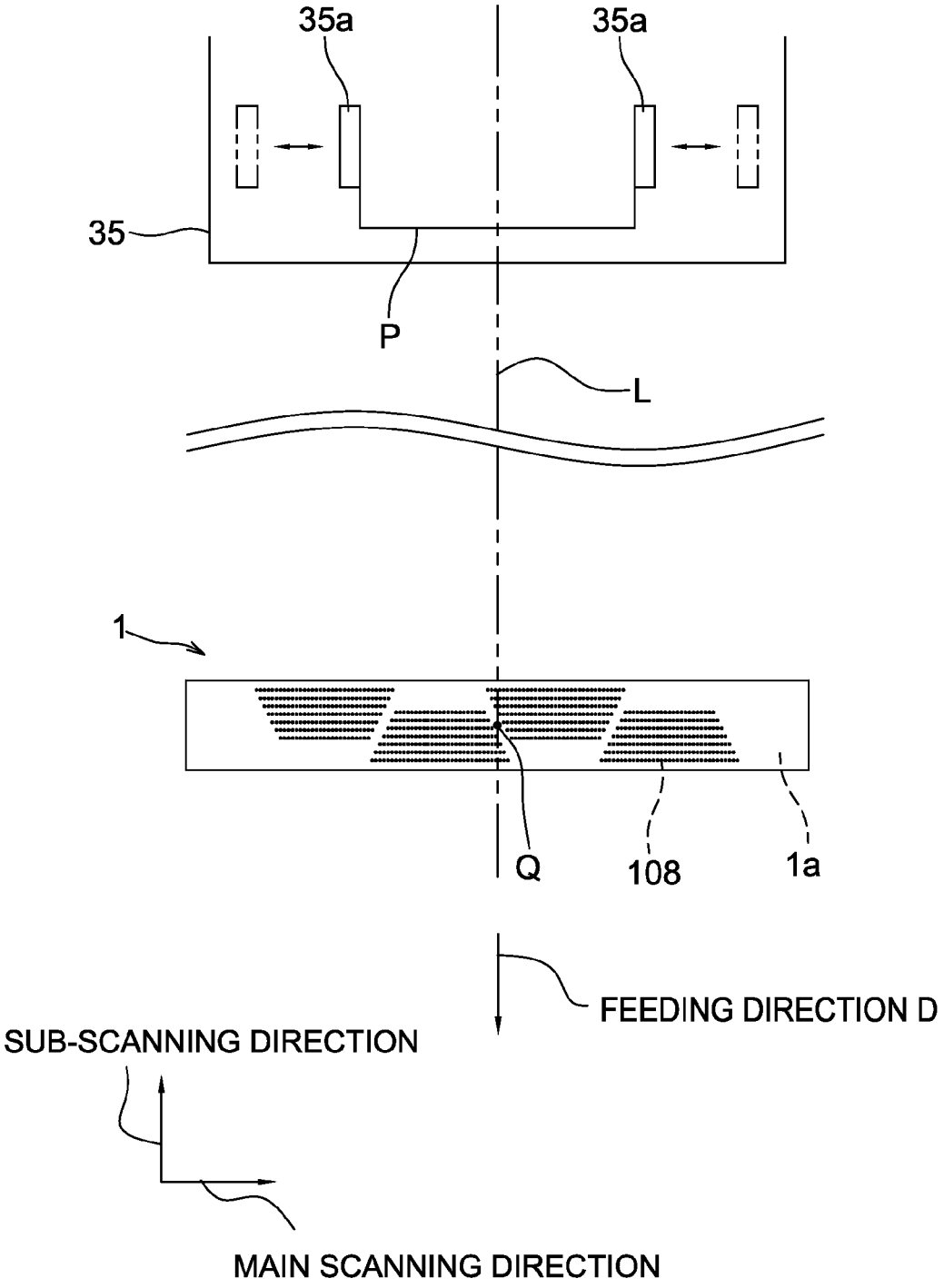
FIG. 11 is a drawing depicting a positional relationship between a sheet accommodated in a sheet supply tray and a nozzle surface of an inkjet head according to an embodiment of the invention.

The sheet supply tray 35 may comprise a slidable guide that may be slidably attached thereto. The slidable guide may allow a plurality of types of the sheets P with various dimensions in the main scanning direction to be loaded on the sheet supply tray 35. The guide may comprise a pair of sheet regulating walls 35*a*, as depicted in FIG. 11, parallel to the feeding direction D of the sheets P. As a user slidably moves one of the sheet regulating walls 35*a* in the main scanning direction, the other one of the sheet regulating walls 35*a* may move in an opposite direction by the same amount, in response to the movement of the one sheet regulating wall 35*a*. The center of a space between the sheet regulating walls 35*a* in the main scanning direction may correspond to the center of the head 1, e.g., the nozzle surface 1*a*, in the main scanning direction, e.g., a straight line L passing through the center point Q, as depicted in FIG. 11, regardless of where the sheet regulating walls 35*a* may be positioned. In other words, as a user slidably moves the sheet regulating walls 35*a*, the center of any types of the sheets P in the main scanning direction may be placed in the same position with respect to the head 1, as depicted in FIG. 11. The sheets P may be fed in the feeding direction D in a center-registration method in which the center of the sheet P in the main scanning direction may correspond to the center of the head 1 in the main scanning direction.

In another embodiment, the sheet supply tray 35 may not comprise the slidable guide but comprise a fixed guide. The fixed guide may comprise a pair of sheet regulating walls that may be fixed to each of a plurality of sheet supply trays. In the sheet supply trays, the distance between the sheet regulating walls in the main scanning direction may be different from each other and the center between the sheet regulating walls may correspond to the center of the head 1 in the main scanning direction.

The cartridge 4 configured to store, e.g., black, ink may be disposed in the space C and may be removably mounted to the casing 101*a*. The cartridge 4 may be connected to the head 1, via a tube and a pump. The pump may be driven to forcibly send ink to the head 1, e.g., when a purging operation is performed or ink is initially introduced to the head 1. At other times, the pump may be stopped and may not prevent the ink supply to the head 1.

Figure 16:
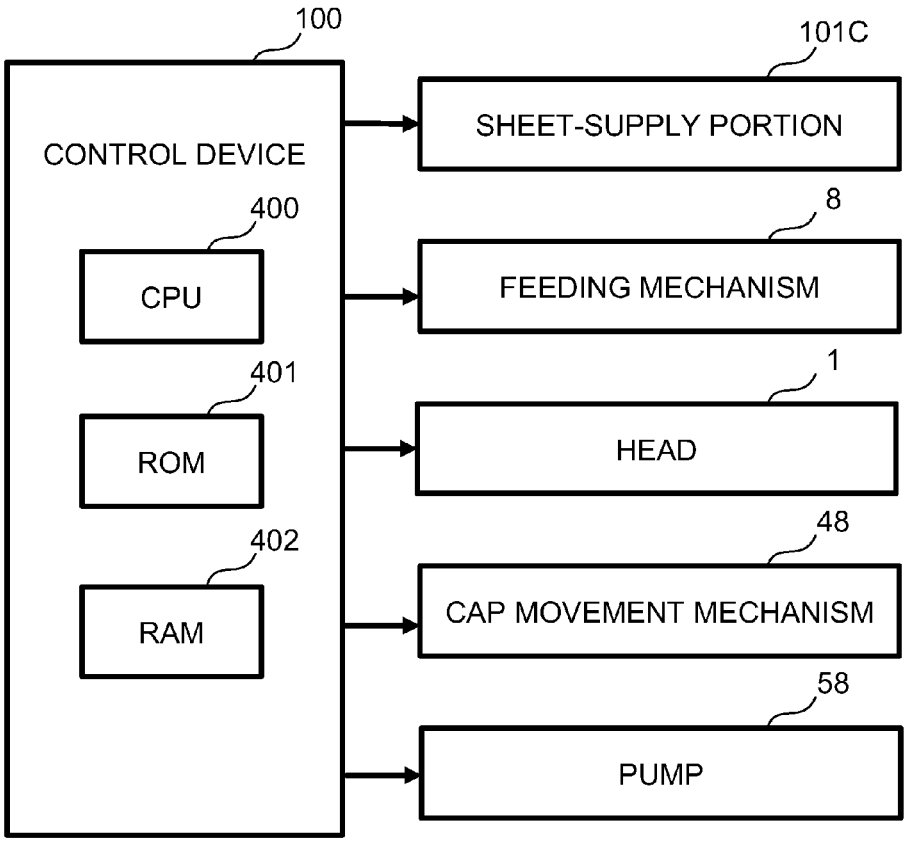
FIG. 16 is a block diagram of a general structure of a control device in FIG. 1.

As depicted in FIG. 16, the control device 100 may comprise: a central processing unit (CPU) 400; a read only memory (ROM) 401 rewritably storing programs to be executed by the CPU and data used for these programs; and a random access memory (RAM) 402 for temporarily storing the data in the execution of the programs. The control device 100 may comprise various functional sections which are constituted by cooperation of these hardware and software in the ROM 401 with each other. The control device 100 may be configured to control an image recording operation and a maintenance operation. In the image recording operation, the control device 100 may drive the sheet supply portion 101*c*, the guide portions 5*a* and 5*b* of the feeding mechanism 8 and the head 1, based on a recording instruction, e.g., an image data, received from an external apparatus, e.g., a personal computer connected to the printer 101. More specifically, the sheet P may be fed from the sheet supply tray 35 to a recording area opposite the head 1. In the recording area, the head 1 may be driven in synchronization with the detection signal from the sheet sensor 32. When the sheet P passes directly below the head 1, ink may be ejected onto the sheet P to form a desired image. The sheet P may further be fed in the feeding direction D to the sheet discharge portion 31 disposed on the upper portion of the casing 101*a*.

In the maintenance operation, an ink discharge operation, e.g., a purging operation and a flushing operation, a capping operation, and a humidifying operation may be performed regularly or in response to user's requests, to maintain or recover ink ejection performance of the head 1.

For example in the ink discharge operation, viscous ink may be discharged from the nozzles 108. The purging operation may be performed to forcibly eject ink from the head 1 by applying a pressure to ink with the pump, without driving the actuator unit 21. After the ink is forcibly discharged, the nozzle surface 1*a* may be wiped to clean the nozzle surface 1*a*. The flushing operation may be performed to eject a predetermined amount of ink from the head 1 by driving the actuator unit 21, based on flushing data that may be different from image data.

The capping operation may be performed when the head 1 is not operated. As depicted in FIG. 4A, the dividing member 41 may divide or enclose the ejection area S1 from an external space S2. The nozzles 108 may communicate only with the divided or enclosed ejection space S1. Thus, a path for the moisture to dissipate from the nozzles 108 may be closed. Thus, increase in the viscosity of ink and drying may be reduced.

The humidifying operation may be performed both when an image recording operation is not performed, e.g., while the capping operation is performed, and when an image recording operation is performed. When performing the humidifying operation while an image recording operation is not performed, the humidified air may be supplied to the enclosed ejection space S1, as depicted in FIG. 4A, via the supply opening portion 65. The air in the ejection space S1 may be discharged, via the discharge opening portion 85. As the humidified air is supplied to the ejection space S1, the ejection space S1 may be filled with vapor. Therefore, drying of the nozzles 108 may be reduced. During a non-operation of the head 1, the humidifying operation may be performed for a predetermined period of time while the capping operation is performed. When performing the humidifying operation while an image recording operation is performed, the humidified air may be supplied from the supply opening portion 65 to the ejection space S1 that may be open to the external space S2, as depicted in FIG. 4B. The air in the ejection space S1 may be discharged from the discharge opening portion 85. As the humidified air is supplied to the ejection space S1, the humidified air may be supplied to the nozzles 108. Therefore, drying of the nozzles 108 may be reduced.

Figure 3A:
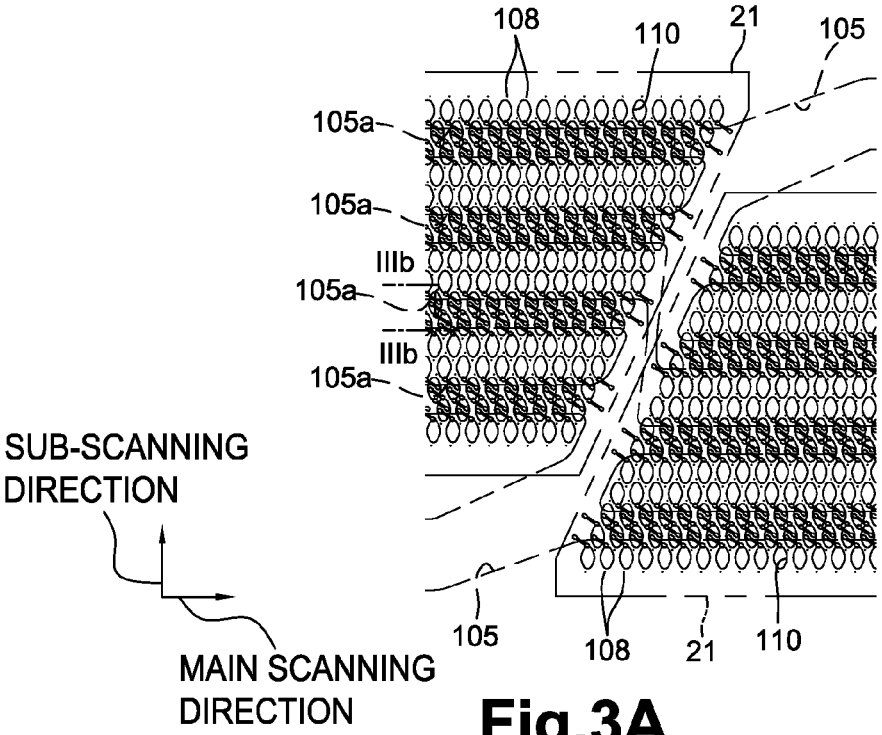
FIG. 3A is an enlarged view of an area 111*a* in FIG. 2A according to an embodiment of the invention.

As depicted in FIG. 2A, the head body 3 may comprise a laminated body comprising the flow path unit 9 and four actuator units 21 fixed on an upper surface 9*a* of the flow path unit 9. The upper surface 9*a* may have openings of pressure chambers 110, as depicted in FIG. 3A, that may be arranged in matrix. The pressure chambers 110 and the nozzles 108 may be provided below the actuator units 21. As depicted in FIG. 3C, each actuator unit 21 may seal the openings of the pressure chambers 110 and define an upper wall of the pressure chambers 110.

Figure 3B:
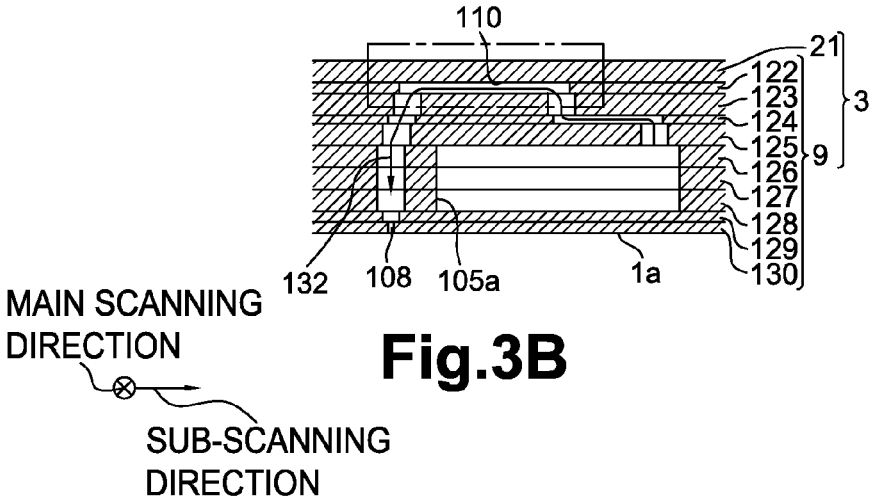
FIG. 3B is a cross-sectional view of the inkjet head taken along a line IIIb-IIIb of FIG. 3A according to an embodiment of the invention.
Figure 3C:
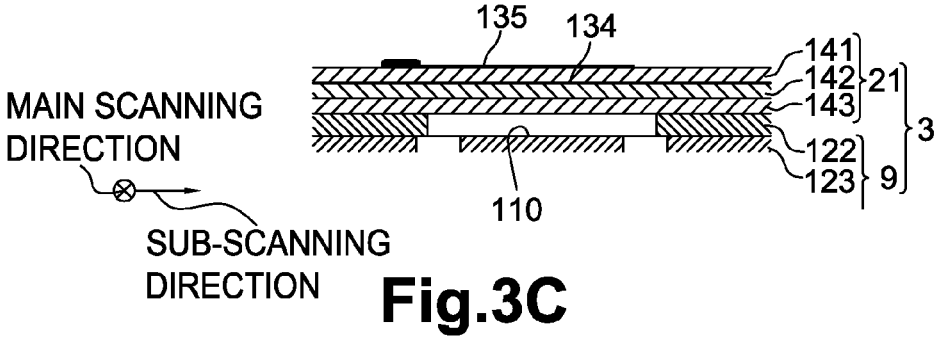
FIG. 3C is a partially enlarged view of a portion of the inkjet head of FIG. 3B according to an embodiment of the invention.

As depicted in FIG. 3B, the flow path unit 9 may comprise a laminated body comprising nine sheets of stainless plates 122-130 that are laminated. The flow path unit 9 may have an ink flow path formed therein. As depicted in FIGS. 2A, 3A, and 3B, the ink flow path may have a manifold flow path 105 that has the ink supply port 105*b* formed on the upper surface 9*a* as an end of the manifold flow path 105 and branches to a sub-manifold flow path 105*a*, and an individual ink flow path leading from an outlet of the sub-manifold flow path 105*a* to the nozzle 108 formed on the lower surface of the flow path unit 9, through the pressure chamber 110. As depicted in FIG. 2B, the nozzles 108 may be arranged in matrix in correspondence with the respective pressure chambers 110 on the nozzle surface 1*a*. The nozzles 108 may be arranged corresponding to a resolution in the main scanning direction, e.g., 600 dpi.

As depicted in FIG. 2A, each of four actuator units 21 may have a trapezoidal shape in plan view. The actuator units 21 may be provided in a staggered manner in the main scanning direction to avoid ink supply ports 105*b*.

The actuator unit 21 may comprise a lead zirconate titanate (PZT)-base ceramic material having ferroelectricity. As depicted in FIG. 3C, the actuator unit 21 may comprise three piezoelectric layers 141-143. The uppermost piezoelectric layer 141 may comprise individual electrodes 135 formed on an upper surface thereof. The piezoelectric layer 141 may be polarized in its thickness direction. The piezoelectric layer 142 may comprise a common electrode 134 formed on all of an upper surface thereof. Portions disposed between the individual electrodes 135 and the pressure chambers 110 may act as individual unimorph-type actuators. When an electric field in a polarized direction occurs in portions between the individual electrodes 135 and the common electrodes 134, the portion acting as the actuators may deform toward the pressure chambers 110, e.g., unimorph deformation. At this time, pressure may be applied to ink in the pressure chambers 110 to eject ink droplets from the nozzles 108. The common electrodes 134 may maintain a ground potential. A driving signal may be selectively supplied to the individual electrodes 135.

A fill-before-fire method may be used to eject ink. The individual electrodes 135 may be kept at a predetermined potential. The actuator may make unimorph deformation. As the driving signal is supplied to the individual electrodes 135, the individual electrodes 135 may be temporarily kept at the same potential as that of the common electrode 134. After the elapse of predetermined time, the potential of the individual electrodes 135 may return to the predetermined potential. At a time when the individual electrodes 135 becomes the same potential as that of the common electrode 134, the unimorph deformation of the actuators may be released, and ink may be drawn into the pressure chambers 110. At a time when the potential of the individual electrodes 135 returns to the predetermined potential, the actuators may make the unimorph deformation again to eject ink droplets from the nozzles 108.

As depicted in FIGS. 2A, 2B, 5A and 5B, a side cover 70 may be provided on an outer periphery of the head body 3. The side cover 70 may be configured to surround the outer circumference of the head body 3. The side cover 70 may comprise an annular member comprising resin. The side cover 70 may be fixed on side surfaces of the flow path unit 9 and the reservoir unit. The side cover 70 may comprise a pair of longer sections 71 extending in the main scanning direction and a pair of shorter sections 72 extending in the sub-scanning direction. The shorter sections 72 may connect the longer sections 71.

A pair of the longer sections 71 may have an inlet and an outlet for the humidified air. The inlet may be disposed in an upper portion of the longer section 71 in FIG. 2A on the upstream side in the feeding direction D. The humidified air may enter the ejection space S1 from the inlet. The inlet may have a through hole 71*a* formed through the upstream-side longer section 71 in a vertical direction, e.g., a direction perpendicular to the nozzle surface 1*a*, and the supply pipe 60 may be inserted into the through hole 71*a*. The outlet may be disposed in a lower portion of the longer section 71 in FIG. 2A on the downstream side in the feeding direction D. Air in the ejection space S1 may be discharged from the outlet. The outlet may have a through hole 71*b* formed through the downstream-side longer section 71 in the vertical direction and the discharge pipe 80 may be inserted into the through hole 71*b*. The through holes 71*a* and 71*b* may be symmetrically disposed with respect to the center point Q on the nozzle surface 1*a*.

The head holder 13 may comprise a rigid frame comprising a metal. The head holder 13 may be configured to support the perimeters of side surfaces of the head body 3. The dividing member 41 of the capping mechanism 40 may be attached to the head holder 13.

A contact portion between the head holder 13 and the head body 3 may be sealed with sealant on the perimeters of the contact portion. A contact portion between the head holder 13 and the dividing member 41 may be fixed by adhesive on the perimeters of the contact portion. The head holder 13 may have through holes 13*a* and 13*b* in correspondence with the through holes 71*a* and 71*b*, respectively. The supply pipe 60 and the discharge pipe 80 may be inserted into the through holes 13*a* and 13*b*, respectively.

Figure 5A:
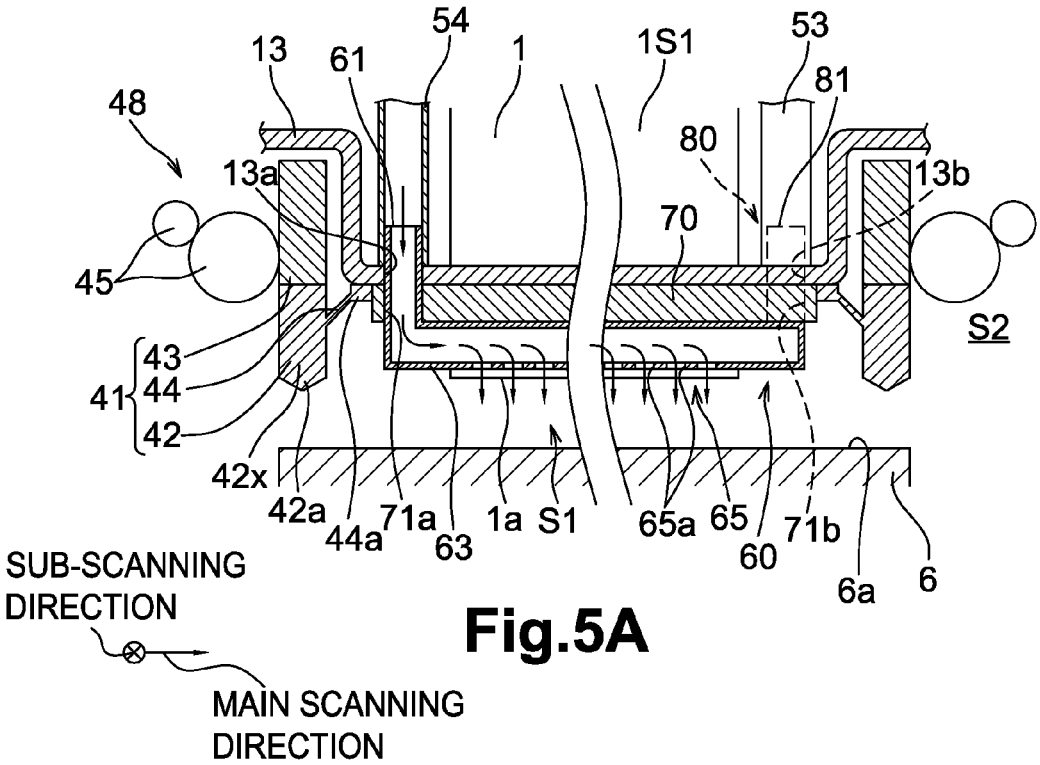
FIG. 5A is a cross-sectional view of the inkjet head taken along a line Va-Va of FIG. 2A according to an embodiment of the invention.
Figure 5B:
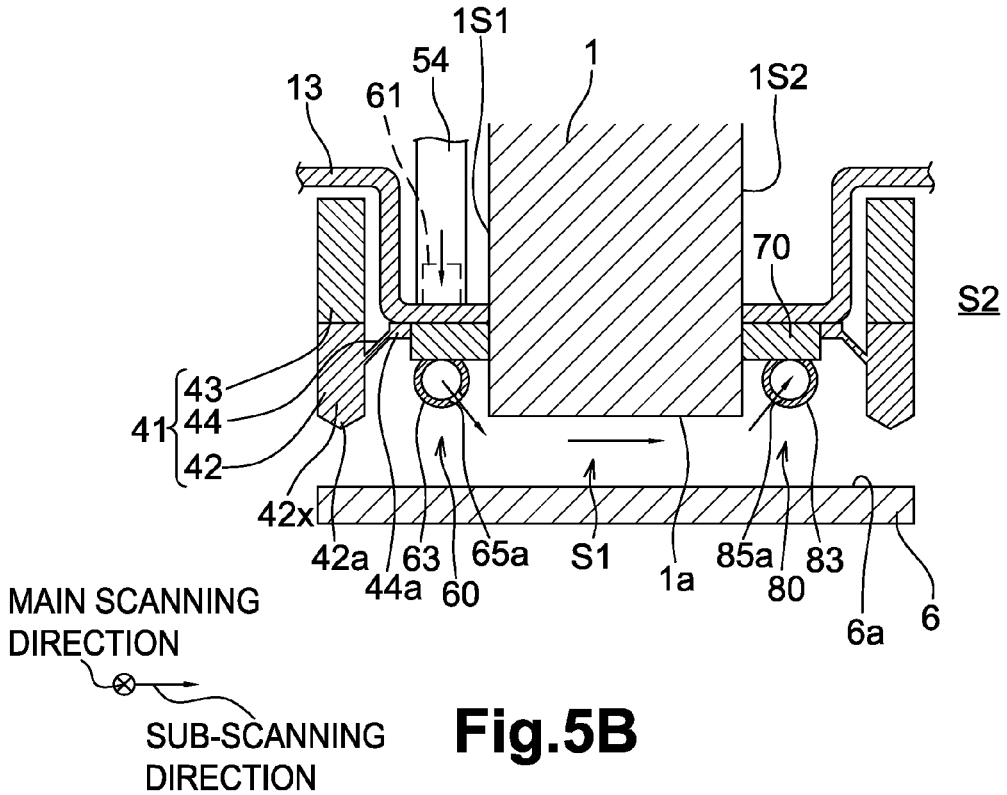
FIG. 5B is a cross-sectional view of the inkjet head taken along a line Vb-Vb of FIG. 2A according to an embodiment of the invention.

The capping mechanism 40 may comprise the dividing member 41, a lip movement mechanism, e.g., a cap movement mechanism 48, configured to move the dividing member 41 up and down, and the platen 6. The dividing member 41 may be configured to enclose the side cover 70 and the ejection space S1, e.g., the nozzles 108, together with the platen 6 and the nozzle surface 1*a*. The dividing member 41 may be elongated in the main scanning direction. As depicted in FIGS. 5A and 5B, the dividing member 41 may comprise a lip member 42, a movable member 43, and a diaphragm 44.

The lip member 42 may comprise an annular-shaped elastic member, e.g., rubber, and may surround the head 1 in plan view. That is, the lip member 42 may be disposed outside the side cover 70. The lip member 42 may comprise a base portion 42*x*, and a protruding portion 42*a* protruding from a lower surface of the base portion 42*x*. The protruding portion 42*a* may have a triangular cross section. An end of the protruding portion 42*a* may be configured to contact the platen 6. The movable member 43 may be fixed to an upper surface of the base portion 42*x*. The movable member 43 may comprise an annular-shaped rigid material, e.g., stainless steel.

The diaphragm 44 may comprise an annular flexible thin-film material, e.g., rubber, and may surround the head 1 in plan view. An outer periphery of the diaphragm 44 may be connected to the lip member 42. The diaphragm 44 may comprise a contact portion 44*a* on an inner periphery thereof. Inner side surfaces of the contact portion 44*a* may be fixed to outer side surfaces of the side cover 70. An upper surface of the contact portion 44*a* may be fixed to a lower surface of the head holder 13.

The cap movement mechanism 48 may comprise gears 45, and a motor. The gears 45 may be connected to the movable member 43. When the motor is driven under the control of the control device 100, the gears 45 may rotate to move the movable member 43 up and down. Accordingly, the base portion 42*x* may move up and down. Thus, the position of an end of the protruding portion 42*a* may change in the vertical direction relative to the nozzle surface 1*a*.

An end of the lip member 42, e.g., the protruding portion 42*a*, may move between a contact position to contact a surface 6*a* of the platen 6, as depicted in FIG. 4A, and a separation position to separate from the surface 6*a*, as depicted in FIGS. 4B-5B, in association with the movement of the movable member 43. When the lip member 42 contacts the surface 6*a*, the dividing member 41, the nozzle surface 1*a* and the platen 6 may divide or enclose the ejection space S1 from the external space S2. Thus, the platen 6 may function as a part of the capping mechanism 40. When the lip member 42 is in the separation position, the ejection space S1 may be open to the external space S2. In the separation position, an end of the lip member 42 may be positioned slightly lower than the nozzle surface 1*a*, so as not to prevent the feeding of the sheets P.

As described above, the humidifying mechanism 50 may comprise the humidified air supplying portion, e.g., the supply pipe 60, the humidified air discharging portion, e.g., the discharge pipe 80, the humidified air generating portion, e.g., the tubes 53 and 54 or discharging tube and supplying tube, the tank 57 and the pump 58.

The supply pipe 60 may correspond to the inlet for the humidified air. As depicted in FIGS. 5A and 5B, the supply pipe 60 may comprise a first supply pipe 61 and a supplying member, e.g., a second supply pipe 63, that may communicate with each other. After the humidified air flows into the first supply pipe 61, the air may be supplied to the ejection space S1, via the second supply pipe 63. The first and second supply pipes 61 and 63 may be symmetrically disposed with respect to the center point Q on the nozzle surface 1*a*.

The first supply pipe 61 may extend in the vertical direction along the upstream-side side surface 1S1 of the head 1. The first supply pipe 61 may be inserted into the through hole 71*a* of the upstream-side longer section 71 and the through hole 13*a* of the head holder 13. The tube 54 may be connected to an exposed end portion of the first supply pipe 61. A gap or a space may be disposed between the first supply pipe 61 and each through hole 13*a*, 71*a*. The gap may be filled with a sealing material.

As depicted in FIG. 5B, an upper portion of the second supply pipe 63 may be bonded to a lower surface of the upstream-side longer section 71. The second supply pipe 63 may be disposed between the lip member 42 and the upstream-side side surface 1S1 of the head 1. As depicted in FIG. 5A, the second supply pipe 63 may extend in the main scanning direction. An end of the second supply pipe 63 may be connected to the first supply pipe 61. The opposite end of the second supply pipe 63 may be closed.

A lower surface of the second supply pipe 63 may be provided with the supply opening portion 65 extending along the upstream-side side surface 1S1 of the head 1. The supply opening portion 65 may have supply openings, e.g., openings, of supply holes 65*a*, formed on the second supply pipe 63. The supply holes 65*a* may be arranged in the main scanning direction and may communicate with an interior of the second supply pipe 63. The supply opening portion 65 may constitute a part of a humidified air supply passage. The humidified air may be uniformly supplied to the ejection space S1 through each supply hole 65*a*.

As depicted in FIG. 2B, the two outermost supply holes 65*a* with respect to the main scanning direction may be disposed outside the respective two outermost nozzles 108 on the nozzle surface 1*a*. In other words, the supply opening portion 65 may have a length longer than the distance between the two outermost nozzles 108. Therefore, the humidified air may be supplied to all nozzles 108, and variances in the supply of the humidified air to all nozzles 108 may be reduced. The second supply pipe 63 may be disposed at a position higher than the nozzle surface 1*a*, so that the second supply pipe 63 may not prevent the feeding of the sheets P.

As depicted in FIG. 5B, the supply holes 65*a* may be formed on a lower portion of the second supply pipe 63 on a side closer to the head 1. The opening of each supply hole 65*a* may oppose the ejection space S1. Thus, the humidified air supplied from the supply holes 65*a* may be effectively flow in the downstream side in the feeding direction D. Accordingly, drying of the nozzles 108 may further be reduced.

The resistance of a passage of the second supply pipe 63 per unit length to the air may become lower toward the downstream side in a flowing direction of the humidified air in the second supply pipe 63, e.g., a rightward direction in FIG. 5A. As depicted in FIG. 2B, areas of openings of the supply holes 65*a* may become greater as the supply holes 65*a* are disposed on the more downstream side, e.g., a downward direction in FIG. 2B. The supply holes 65*a* may be disposed further from the upstream side, e.g., an upward direction in FIG. 2B, toward the downstream side, in the flowing direction of the humidified air. Therefore, approximately a uniform amount of the humidified air may flow from each supply hole 65*a*. In another embodiment, a cross-sectional area of the passage of the second supply pipe 63 may be increased from the upstream side toward the downstream-side in the flowing direction of the humidified air.

The discharge pipe 80 may correspond to the outlet for the humidified air. The discharge pipe 80 may comprise a first discharge pipe 81 and a discharging member, e.g., a second discharge pipe 83, that may communicate with each other. After the air in the ejection space S1 flows into the second discharge pipe 83, the air may be discharged to the humidified air generating portion, via the first discharge pipe 81. The first and second discharge pipes 81 and 83 may be structured, similar to the first and second supply pipes 61 and 63, respectively. The first and second discharge pipes 81 and 83 may be symmetrically disposed with respect to the center point Q on the nozzle surface 1*a*.

The first discharge pipe 81 may extend in the vertical direction along the downstream-side side surface 1S2 of the head 1. The first discharge pipe 81 may be inserted into the through holes 71*b* and 13*b*. The tube 53 may be connected to an exposed end portion of the first discharge pipe 81. An upper portion of the second discharge pipe 83 may be bonded to a lower surface of the downstream-side longer section 71. The second discharge pipe 83 may be disposed between the lip member 42 and the downstream-side side surface 1S2 of the head 1. The second discharge pipe 83 may extend in the main scanning direction. An end of the second discharge pipe 83 may be connected to the first discharge pipe 81. The opposite end of the second discharge pipe 83 may be closed.

A lower surface of the second discharge pipe 83 may be provided with the discharge opening portion 85 extending along the downstream-side side surface 1S2. The discharge opening portion 85 may have discharge openings, e.g., openings, of discharge holes 85*a*, formed on the second discharge pipe 83. The discharge holes 85*a* may be arranged in the main scanning direction and may communicate with an interior of the second discharge pipe 83. The discharge opening portion 85 may be a part of a humidified air discharge passage. The air in the ejection space S1 may be discharged from each discharge hole 85*a*.

As depicted in FIG. 2B, the two outermost discharge holes 85*a* with respect to the main scanning direction may be disposed outside the respective two outermost nozzles 108 on the nozzle surface 1*a*. The discharge opening portion 85 may have a length longer than the distance between the two outermost nozzles 108. Therefore, the humidified air supplied from the supply opening portion 65 may easily flow in a direction parallel to the sub-scanning direction, e.g., the feeding direction D. Variances in the supply of the humidified air to all nozzles 108 may be reduced. The second discharge pipe 83 may be disposed at a position higher than the nozzle surface 1*a*, so that the second discharge pipe 83 may not prevent the feeding of the sheets P.

As depicted in FIG. 5B, the discharge holes 85*a* may be formed on a lower portion of the second discharge pipe 83 on a side closer to the head 1. The opening of each discharge hole 85*a* may oppose the ejection space S1. Thus, the air in the ejection space S1 may be readily discharged.

The resistance of a passage of the second discharge pipe 83 per unit length to the air may become greater toward the downstream side in a flowing direction of the humidified air in the second discharge pipe 83, e.g., a downward direction in FIG. 2B). Areas of openings of the discharge holes 85*a* may become smaller as the discharge holes 85*a* are disposed on the more downstream side, e.g., a downward direction in FIG. 2B). The discharge holes 85*a* may be disposed further from the upstream side, e.g., an upward direction in FIG. 2B, toward the downstream side, in the flowing direction of the humidified air. Therefore, approximately a uniform amount of the humidified air may flow into each discharge hole 85*a*. In another embodiment, a cross-sectional area of the passage of the second discharge pipe 83 may be reduced from the upstream side toward the downstream-side in the flowing direction of the humidified air.

The tubes 53 and 54, the tank 57, the supply pipe 60, and the discharge pipe 80 may constitute a circulation passage for the humidified air. As depicted in FIGS. 4A and 4B, an end of the tube 53 may be connected to the discharge pipe 80 and an opposite end of the tube 53 may be connected to the tank 57. The pump 58 may be disposed between the tube 53 and the tank 57. An end of the tube 54 may be connected to the tank 57 and an opposite end of the tube 54 may be connected to the supply pipe 60.

The tank 57 may be configured to store humidifying liquid in its lower portion and the air humidified by the humidifying liquid in its upper portion. The tube 53 may be in fluid communication with the lower portion of the tank 57 storing the humidifying liquid. The tube 54 may be in fluid communication with the upper portion of the tank 57. A check valve may be attached to a portion of the tube 53 near the tank 57 to prevent or reduce backflow of the humidifying liquid in the tank 57. When the humidifying liquid in the tank 57 is reduced, the liquid may be replenished to the tank 57 from a replenishment tank.

The printer 101 may perform the capping operation and the humidifying operation while an image recording operation is not performed.

When the capping operation is performed, the lip member 42 may be placed in the contact position, as depicted in FIG. 4A, under the control of the control device 100. The dividing member 41 may divide or enclose the ejection space S1 from the external space S2. Consequently, a path for the humidified air may be formed in the lateral direction of the head 1, e.g., the sub-scanning direction, in the dividing member 41.

Ink adjacent to the nozzles 108 may become dry if the ejection space S1 is continuously divided or enclosed by the capping operation. When the printer 101 is used for a long period of time, an inner wall of the dividing member 41 may be contaminated with ink mist or ink itself. Residual ink in the dividing member 41 that has been dried may function as a desiccant that may absorb humidity and moisture. Therefore, the residual ink in the dividing member 41 may promote drying of ink adjacent to the nozzles 108 in the enclosed ejection space S1.

The nozzles 108 may be positioned between the supply opening portion 65 and the discharge opening portion 85 with respect to the lateral direction of the head 1. When the head 1 is not operated and the ejection space S1 is divided from the external space S2, the humidified air may be supplied to the ejection space S1 to humidify the nozzles 108.

When the humidifying operation is performed when the ejection space S1 is enclosed, e.g., while an image recording operation is not performed, the pump 58 may be driven under the control of the control device 100. As depicted in FIG. 4A, the air may flow in a direction indicated by outline arrows. The humidified air in the upper portion of the tank 57 may be supplied to the second supply pipe 63, via the tube 54 and the first supply pipe 61. The humidified air may be supplied to the ejection space S1 from the supply holes 65*a* of the supply opening portion 65. While the air in the ejection space S1 is replaced with the humidified air, the air may flow in the sub-scanning direction toward the discharge opening portion 85. The air in the ejection space S1 may be suctioned by the pump 58 through the first discharge pipe 81, to flow from the discharge opening portion 85 to the tank 57. The air may be humidified in the lower portion of the tank 57 and may move to the upper portion of the tank 57. The generated humidified air may be supplied to the ejection space S1 while the pump 58 is being driven.

When the uncapping operation is performed, the lip member 42 may be placed in the separation position as depicted in FIGS. 4B-5B, under the control of the control device 100. The dividing member 41 may open the ejection space S1 to the external space S2.

The printer 101 may perform an image recording operation, based on a received recording instruction. The humidifying operation may be performed while an image recording operation is performed, under the control of the control device 100. The pump 58 may be driven under the control of the control device 100. As depicted in FIG. 4B, the air may flow in a direction indicated by the outline arrows, similar to the humidifying operation that may be performed when the ejection space S1 is enclosed while an image recording operation is not performed. The humidified air in the upper portion of the tank 57 may be supplied to the second supply pipe 63, via the tube 54 and the first supply pipe 61. The humidified air may be supplied to the ejection space S1 and to the nozzles 108 from the supply holes 65*a* of the supply opening portion 65.

The humidified air may be moved from the supply holes 65*a* to the nozzles 108 by the air current associated with the feeding of the sheet P. At this time, the air in the ejection space S1 may be forcibly suctioned by the pump 58 to move from the discharge opening portion 85 to the tank 57. The air in the ejection space S1 may be discharged outside, e.g., to the tank 57, from the discharge opening portion 85 disposed downstream of the head 1 in the feeding direction D. Thus, flow of the humidified air may be formed from the supply opening portion 65 to the discharge opening portion 85. Even when the air current associated with the feeding of the sheet P is not present near the nozzle surface 1*a*, e.g., before the sheet P passes the nozzle surface 1*a* or after the elapse of some time after the sheet P has passed the nozzle surface 1*a*, the humidified air may be supplied to the nozzles 108 because the air in the ejection space S1 may be forcibly suctioned by the pump 58 and flow from the supply opening portion 65 to the discharge opening portion 85. Consequently, even when the head 1 is uncapped, e.g., the ejection space S1 is open, drying of the nozzles 108 may be reduced. Therefore, an amount of ink consumed by the flushing operation may be reduced. The air suctioned from the discharge opening portion 85 may be humidified in the lower portion of the tank 57 and may move to an upper portion of the tank 57, similar to the humidifying operation that may be performed when the ejection space S1 is enclosed while an image recording operation is not performed. The generated humidified air may be supplied to the ejection space S1 while the pump 58 is being driven. When the head 1 is uncapped, part of the humidified air output from the supply holes 65*a* is likely not to flow to the discharge opening portion 85 because of turbulence. So, the control device 100 may control the pump 58 such that flow amount of the humidified air output from the supply holes 65*a* per unit time when the head 1 is uncapped is greater than flow amount of the humidified air output from the supply holes 65*a* per unit time when the head 1 is capped so that flow amount of the humidified air from the ejection space S1 to the discharge opening portion 85 per unit time when the head 1 is uncapped become the same as flow amount of the humidified air from the ejection space S1 to the discharge opening portion 85 per unit time when the head 1 is capped.

The opening areas of the supply holes 65*a* may increase toward a downstream side in the flowing direction of the humidified air. The resistance of the passage of the second supply pipe 63 per unit length to the air may decrease toward the downstream side in the flowing direction of the humidified air in the second supply pipe 63. Therefore, approximately a uniform amount of the humidified air may flow from each supply hole 65*a*. In the ejection space S1, the air current may flow in the feeding direction D. As the supply opening portion 65 is disposed along the upstream-side side surface 1S1 of the head 1, the humidified air may be effectively supplied to the nozzles 108.

An end of the lip member 42 may be placed at a position slightly lower than the nozzle surface 1*a* in the separation position. Thus, the humidified air supplied to the ejection space S1 may stay in the ejection space S1. Therefore, the humidified air may be effectively supplied to the nozzles 108, and drying of the nozzles 108 may further be reduced.

The humidifying operation may be performed both when an image recording operation is performed and when the image recording operation is not performed and the ejection space S1 is divided or enclosed by the capping operation. In the humidifying operation, the humidified air supplied from the supply opening portion 65 may flow in the feeding direction D e.g., the lateral direction of the head 1. In other words, the humidified air may flow toward the discharge opening portion 85 through the ejection space S1. Because the supply opening portion 65 and the discharge opening portion 85 extend in the longitudinal direction of the head 1, the humidified air may be supplied to the nozzles 108. The head 1 may be disposed between the supply opening portion 65 and the discharge opening portion 85 in the feeding direction D. Therefore, a path for supplying the humidified air may be relatively short. Therefore, variances in the humidity of the humidified air supplied in the feeding direction D may be reduced. Thus, variances in the drying of ink in the nozzles 108 may be reduced while an image recording operation is performed, or is not performed when the ejection space S1 is closed.

When the humidifying operation is performed during an image recording operation, the air current may flow in the feeding direction D in the ejection space S1, in association with the feeding of the sheet P. Therefore, the humidified air may be effectively supplied to the nozzles 108, so that drying of the nozzles 108 may be reduced when the ejection space S1 is open during an image recording operation. Thus, discharge of ink by the flushing operation, may be reduced.

In the humidifying operation, the air in the ejection space S1 may be forcibly discharged from the discharge opening portion 85. Therefore, the supplied humidified air may flow in the feeding direction D. Thus, variances in the supply of the humidified air may be reduced.

In the air flow passage, the humidified air may circulate between the pump 58 and the ejection space S1. A resistance of an air flow passage from the pump 58 to each supply hole 65*a*, and a resistance of an air flow passage from each discharge hole 85*a* to the pump 58 may be uniformly set. Thus, variances in the drying of ink in the nozzles 108 may be reduced on the whole.

An axis of an opening of each supply hole 65*a* of the supply opening portion 65 and each discharge hole 85*a* of the discharge opening portion 85 may be inclined toward an inner side of the ejection space S1. Therefore, the humidified air may be effectively circulated and moisture may be supplied uniformly to the nozzles 108.

The capping mechanism 40 may comprise the dividing member 41, the cap movement mechanism 48 and the platen 6, e.g., opposing member. Therefore, the capping mechanism 40 may be relatively smaller in size, and may reduce the size of the printer 101.

Figures 12A, 12B:
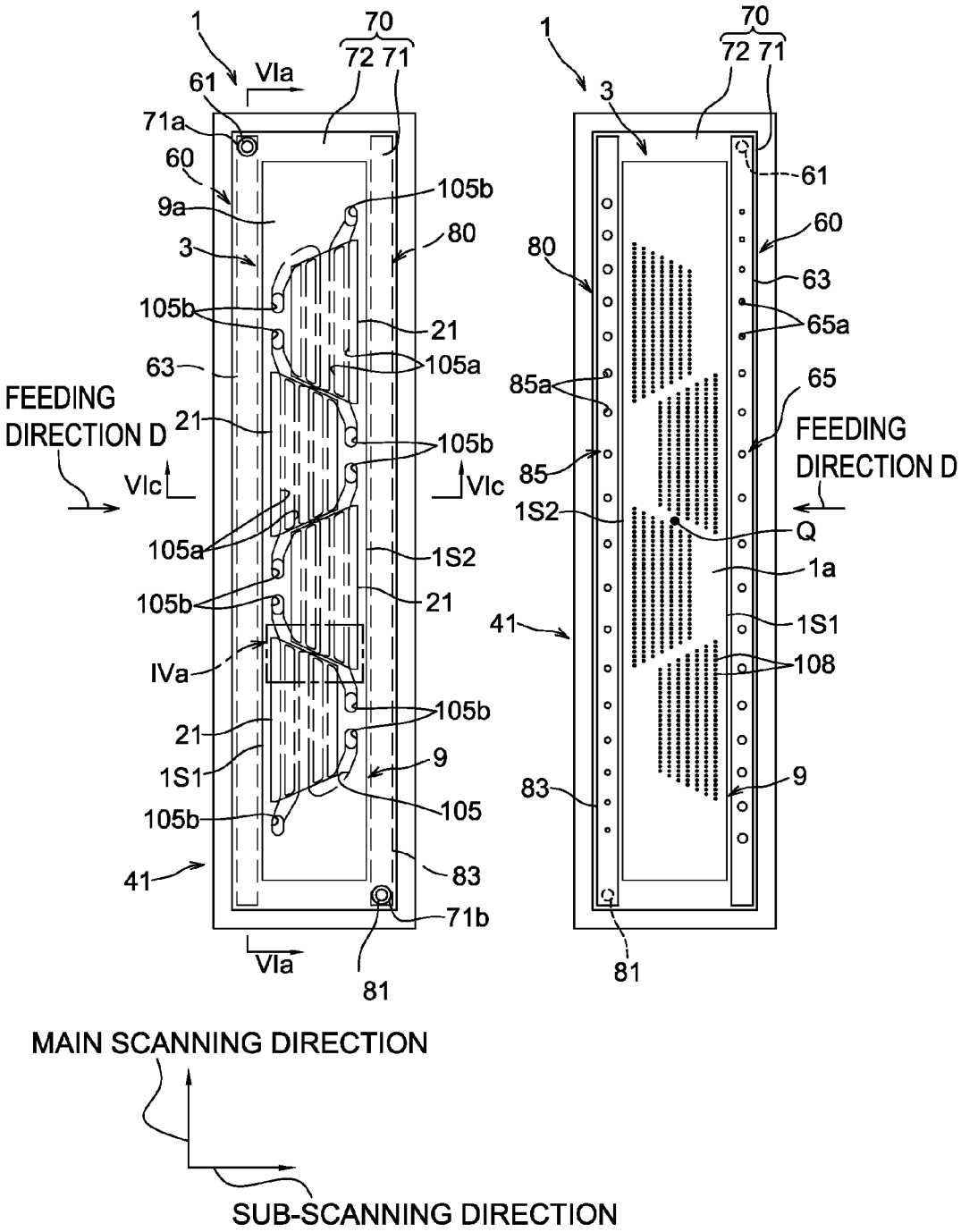
FIG. 12A is a top view of an inkjet head according to an embodiment of the invention.
FIG. 12B is a bottom view of the inkjet head of FIG. 12A.
Figure 13A:
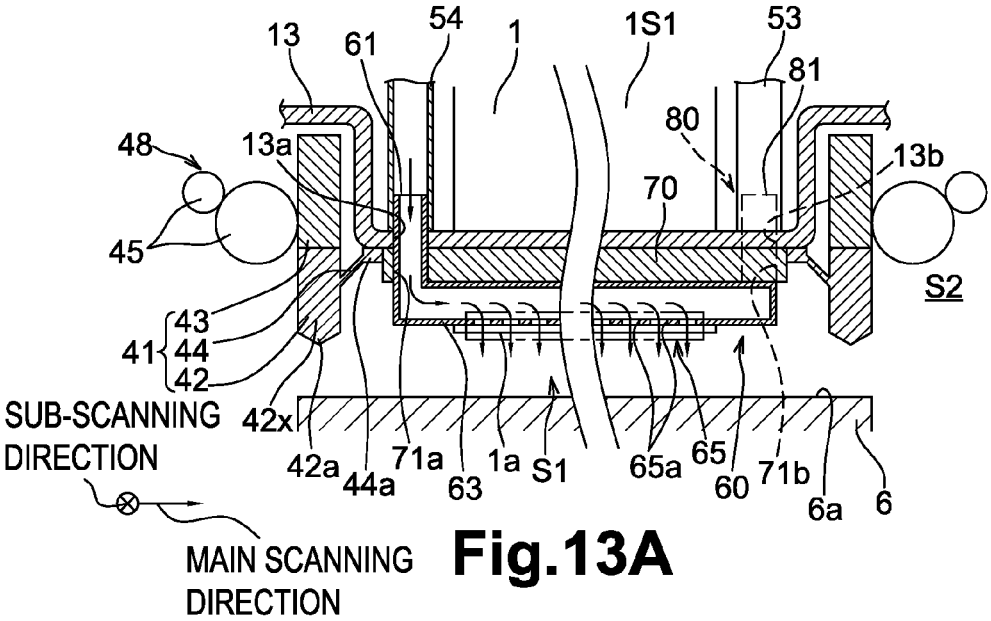
FIG. 13A is a cross-sectional view of the inkjet head taken along a line VIa-VIa of FIG. 12A.
Figure 13B:
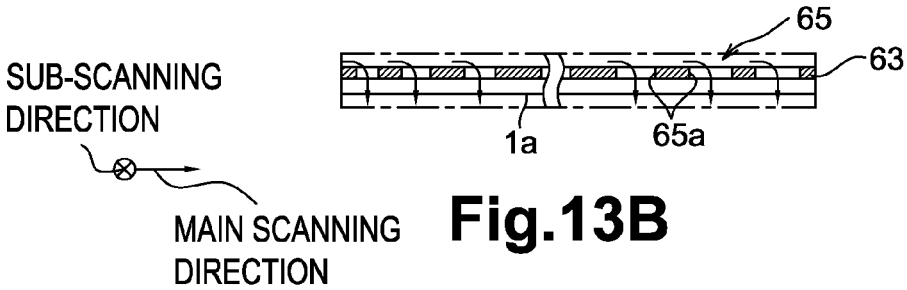
FIG. 13B is an enlarged view of an area enclosed by a dotted line in FIG. 13A.
Figure 13C:
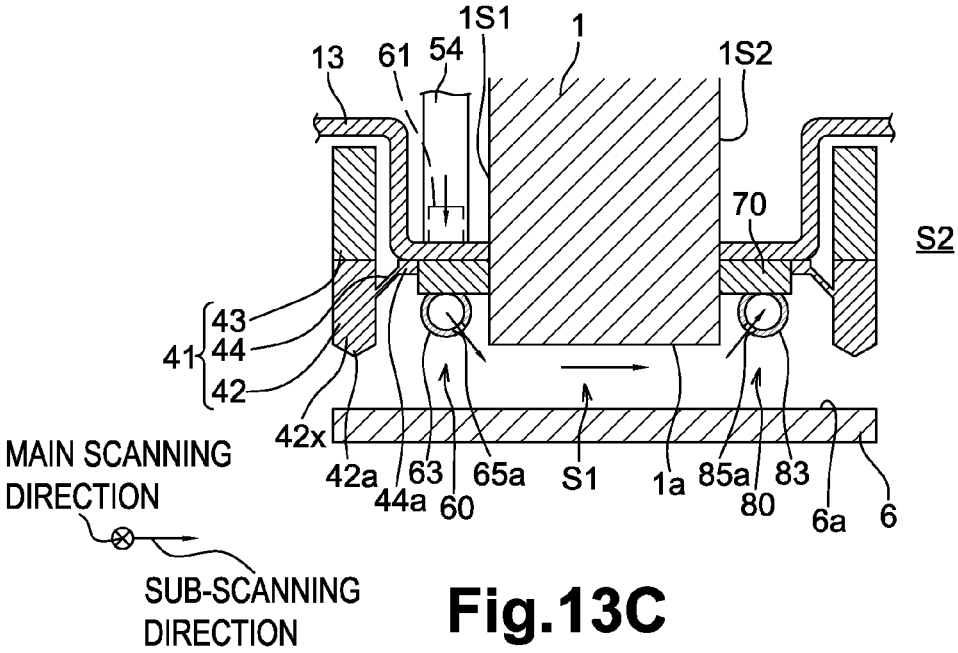
FIG. 13C is a cross-sectional view of the inkjet head taken along a line VIc-VIc of FIG. 12A.

As depicted in FIGS. 12B and 13B, in another embodiment, a distance between the adjacent two supply openings, e.g., openings, of the supply holes 65*a* may become shorter toward a more outer portion of the head 1 from its central portion in the main scanning direction. Therefore, the number of openings of the supply holes 65*a* may be greater in the outer portion of the head 1 than its central portion in the main scanning direction. Therefore, a greater amount of the humidified air may be supplied to an outer portion of the ejection space S1 than its central portion in the main scanning direction.

A distance between the adjacent two discharge openings, e.g., openings, of the discharge holes 85*a* may become shorter toward a more outer portion of the head 1 than its central portion in the main scanning direction. Therefore, the number of openings of the discharge holes 85*a* may be greater in the outer portion of the head 1 than its central portion in the main scanning direction. Therefore, a greater amount of the air may be discharged from an outer portion of the ejection space S1 than its central portion in the main scanning direction.

The printer 101 may perform an image recording operation, as described above, based on a received recording instruction. In this embodiment, the sheet P may be fed in the center-registration method. In the center-registration method, the sheet P may be placed on the sheet supply tray 35 such that the center of the sheet P in the main scanning direction may correspond to the center of the nozzle surface 1*a*, e.g., the line L passing the center point Q, in the main scanning direction. In a recording area, the sheet P may be fed such that the center of the sheet P in the main scanning direction may align with the center of a distribution area of the nozzles 108 in the main scanning direction. If the size of the sheet P is smaller than the distribution area of the nozzles 108, the nozzles 108 disposed on each end in the main scanning direction may be exposed to the atmosphere. The drying of the nozzles 108 may occur while an image recording operation is performed.

When an image recording operation is performed, the humidifying operation may be performed under the control of the control device 100. In this embodiment, more supply holes 65*a* of the supply opening portion 65 may be disposed on a more outer portion of the head 1 than its central portion in the main scanning direction.

When the humidifying operation is performed while an image recording operation is performed, the pump 58 may be driven under the control of the control device 100. As depicted in FIG. 4B, the air may flow in a direction indicated by the outline arrows, similar to the humidifying operation that may be performed when the ejection space S1 is enclosed while an image recording operation is not performed, as described above. The humidified air in the upper portion of the tank 57 may be supplied to the second supply pipe 63 via the tube 54 and the first supply pipe 61. The humidified air may be supplied to the ejection space S1 and to the nozzles 108 from the supply holes 65*a* of the supply opening portion 65.

The humidified air may be moved from the supply holes 65*a* to the nozzles 108 by the air current associated with the feeding of the sheet P. At the downstream of the head 1 in the feeding direction D, the air in the ejection space S1 may be forcibly suctioned by the pump 58, to move from the discharge opening portion 85 to the tank 57. Thus, flow of the humidified air may be formed from the supply opening portion 65 to the discharge opening portion 85. Even when the air current associated with the feeding of the sheet P does not flow near the nozzle surface 1*a*, e.g., before the sheet P passes the nozzle surface 1*a* and after the elapse of some time after the sheet P has passed the nozzle surface 1*a*, the humidified air may be supplied to the nozzles 108 because the air in the ejection space S1 may be forcibly suctioned by the pump 58 and flow from the supply opening portion 65 to the discharge opening portion 85. Consequently, even when the head 1 is uncapped, e.g., the ejection space S1 is open, drying of the nozzles 108 may be reduced. Therefore, an amount of ink consumed by the flushing operation, may be reduced.

Opening areas of the supply holes 65*a* may become greater toward a more downstream side in the flowing direction of the humidified air. The resistance of the passage of the second supply pipe 63 per unit length to the air may decrease toward the downstream side in the flowing direction of the humidified air in the second supply pipe 63. Therefore, approximately a uniform amount of the humidified air may flow from each supply hole 65*a*. Further, the number of the supply holes 65*a* may be greater in the outer portion of the head 1 than its central portion in the main scanning direction. Therefore, a greater amount of the humidified air may be supplied to an outer portion of the ejection space S1 than its central portion in the main scanning direction. The nozzles 108 disposed outward at each end portion of the head 1 in the main scanning direction may be less frequently used and may be readily dried in the feeding of the sheets P with the center-registration method. Drying of the nozzles 108 may be effectively reduced as a greater amount of the humidified air may be supplied to an outer portion of the ejection space S1. Therefore, an amount of ink consumed by the flushing operation may be reduced. The air suctioned from the discharge opening portion 85 may be humidified in the lower portion of the tank 57 and may move to the upper portion of the tank 57, similar to the humidifying operation that may be performed when the ejection space S1 is closed while an image recording operation is not performed, as described above. The generated humidified air may be supplied to the ejection space S1 while the pump 58 is driven.

An end of the lip member 42 may be placed at a position slightly lower than the nozzle surface 1*a* in the separation position. Thus, the humidified air supplied from the supply holes 65*a* of the supply opening portion 65 to the ejection space S1 may readily stay in the ejection space S1. Therefore, the humidified air may be effectively supplied to the nozzles 108, and drying of the nozzles 108 may further be reduced.

The humidifying operation may be performed while an image recording operation is performed. In the humidifying operation, the humidified air supplied from the supply opening portion 65 may flow toward the discharge opening portion 85 across the ejection space S1 by riding the air current associated with the feeding of the sheet P. Thus, drying of the nozzles 108 may be reduced when the ejection space S1 is open during an image recording operation. Further, a greater amount of the humidified air may be supplied to an outer portion of the ejection space S1 than its central portion in the main scanning direction. Therefore, drying of the less-frequently used nozzles 108, which may be disposed outward, e.g., on each end portion of the nozzle surface 1*a* in the main scanning direction, may be effectively reduced. Consequently, discharge of ink by the flushing operation may be reduced.

The humidifying operation may also be performed when the ejection space S1 is divided or enclosed by the capping operation while an image recording operation is not performed. Therefore, when the ejection space S1 is divided from the external space S2, drying of ink in the nozzles 108 may be reduced.

In the humidifying operation, the air in the ejection space S1 may be discharged from the discharge opening portion 85. Therefore, the humidified air supplied from the supply opening portion 65 may readily flow in the feeding direction D, e.g., the lateral direction of the head 1. In other words, the air may flow toward the discharge opening portion 85 through the ejection space S1. Consequently, drying of ink in the nozzles 108 may be effectively reduced.

As described above, the capping mechanism 40 may comprise the dividing member 41, the cap movement mechanism 48, and the platen 6. Therefore, the capping mechanism 40 may be relatively smaller in size, and may reduce the size of the printer 101. An axis of the opening of each supply hole 65*a* of the supply opening portion 65 and each discharge holes 85*a* of the discharge opening portion 85 may incline toward the inner side of the ejection space S1. Such structure may contribute to an effective circulation of the humidified air in the ejection space S1 and a uniform moisture supply to the nozzles 108.

Figure 6A:
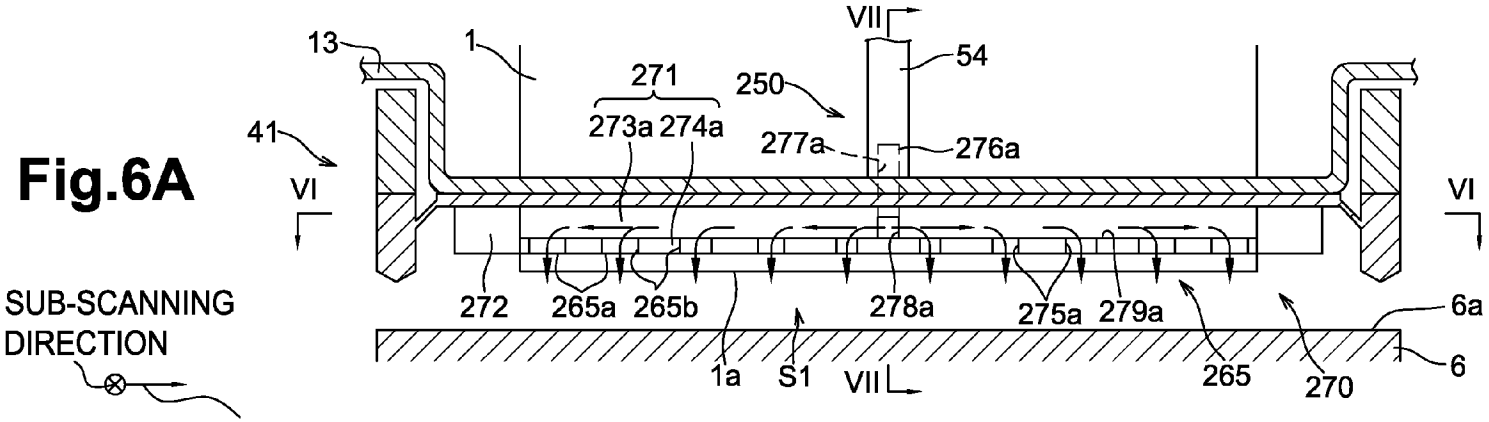
FIG. 6A is a drawing depicting a side cover and a capping mechanism according to another embodiment of the invention.
Figure 6B:
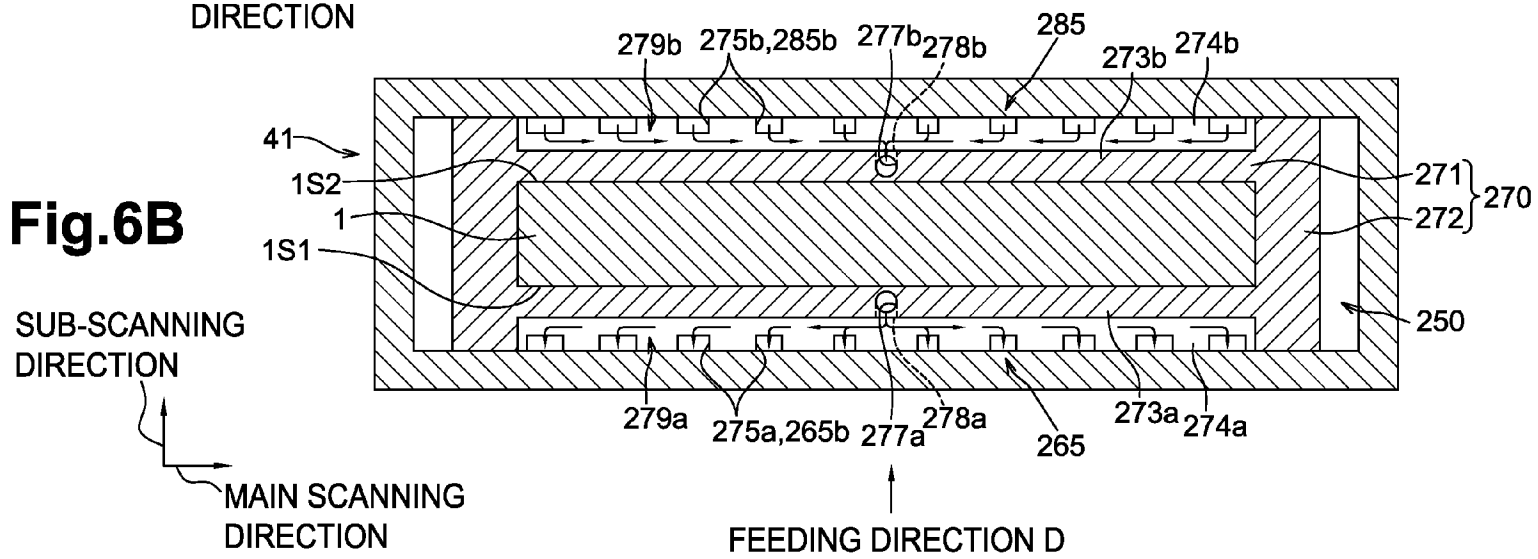
FIG. 6B is a cross-sectional view of the side cover and the capping mechanism taken along a line VI-VI of FIG. 6A.
Figure 7:
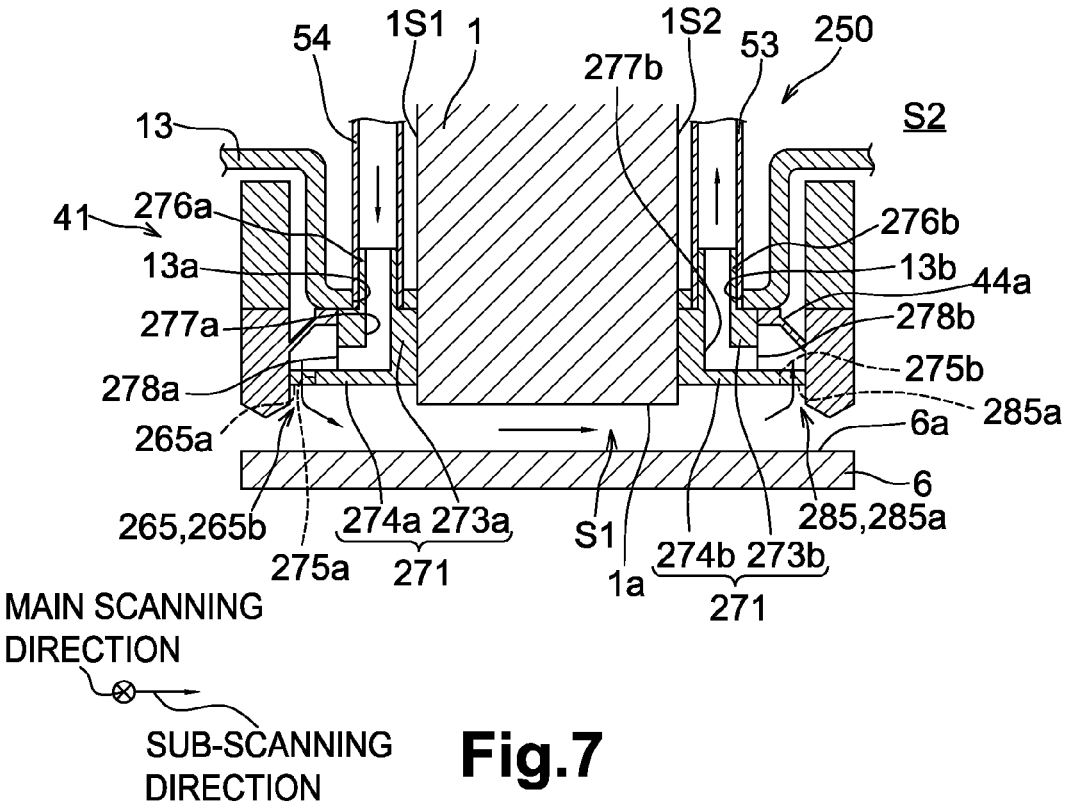
FIG. 7 is a cross-sectional view of the side cover and the capping mechanism taken along a line VII-VII of FIG. 6A.

Referring to FIGS. 6A-7, in still another embodiment, a humidifying mechanism 250 may comprise the humidified air supplying portion and the humidified air discharging portion that may defined by a side cover 270 and the dividing member 41. The side cover 270 may be configured to surround the outer circumference of the head 1. The side cover 270 may comprise an annular member comprising resin. The side cover 270 may comprise a pair of longer sections 271 extending in the main scanning direction and a pair of shorter sections 272 extending in the sub-scanning direction. The longer sections 271 may have the same length as the side surfaces 1S1 and 1S2 of the head 1 in the main scanning direction. The shorter sections 272 may connect the longer sections 271.

The upstream-side longer section 271 in the feeding direction D may comprise an upstream-side fixed portion 273*a* and an upstream-side flange 274*a* in the feeding direction D. The upstream-side fixed portion 273*a* may extend in the main scanning direction, and may be fixed to the side surface 1S1 of the head 1. The contact portion 44*a* may be fixed to an outer side surface of the upstream-side fixed portion 273*a*. The upstream-side flange 274*a* may be integrally formed with the upstream-side fixed portion 273*a*. The upstream-side flange 274*a* may protrude from a lower end of the upstream-side fixed portion 273*a* toward the upstream side in the feeding direction D. The upstream-side flange 274*a* may extend in the main scanning direction.

The upstream-side flange 274*a* may have recesses 275*a* formed at an end thereof, e.g., an upstream end in the feeding direction D. The recesses 275*a* may pass through the upstream-side flange 274*a* in the vertical direction. The recesses 275*a* may define, together with the lip member 42, supply openings, e.g., openings 265*a*, and guide paths 256*b* connected to the openings 265*a*. The openings 265*a* defined by the recesses 275*a* and the lip member 42 may correspond to a supply opening portion 265. The openings 265*a* of the recesses 275*a* may be disposed equidistantly in the main scanning direction. The two outermost openings 265*a* of the recesses 275*a* may be disposed outside the respective two outermost nozzles 108 on the nozzle surface 1*a*. The supply opening portion 265 may have a length longer than the distance between the two outermost nozzles 108. Therefore, effects similar to those of the aforementioned embodiments may be obtained. The lower surface of the side cover 270 may be disposed at a position higher than the nozzle surface 1*a*, so that the side cover 270 may not prevent the feeding of the sheet P.

The upstream-side fixed portion 273*a* may comprise a protruding portion 276*a* protruding upward. The protruding portion 276*a* may be disposed on a central portion of an upper surface of the upstream-side fixed portion 273*a* in the main scanning direction. The upstream-side fixed portion 273*a* may have a flow path 277*a* extending in the vertical direction from a central portion of the upstream-side fixed portion 273*a* in the main scanning direction. The flow path 277*a* may pass through a central portion of the protruding portion 276*a* to communicate with an opening 278*a* formed on a side surface of the upstream-side fixed portion 273*a*. The protruding portion 276*a* may be inserted into the through hole 13*a* of the head holder 13 and connected to the tube 54. A gap or a space may be disposed between the protruding portion 276*a* and the through hole 13*a*. The gap may be filled with a sealing material. The humidified air may flow through the opening 278*a*, via the tube 54. An end of the upstream-side flange 274*a* may contact an inner peripheral surface of the lip member 42. The shorter section 272 may contact the diaphragm 44 on each end thereof in the sub-scanning direction. An area enclosed by the upstream-side longer section 271 and the dividing member 41 may be enclosed at each end in the main scanning direction to form a flow path 279*a* connected to the flow path 277*a*. As depicted in FIGS. 6A and 6B, the humidified air may flow from the opening 278*a* in the flow path 279*a* in the right and left directions in FIGS. 6A and 6B and be supplied to the ejection space S1 from the recesses 275*a*. The recesses 275*a*, e.g., the openings 265*a* and the guide paths 265*b*, and the flow paths 277*a* and 279*a* may constitute a humidified air supply passage through which the humidified air may be supplied to the ejection space S1.

As depicted in FIGS. 6A and 6B, areas of the openings 265*a* of the recesses 275*a* may be become greater as the openings 265*a* toward a more downstream side, e.g., outward sides in FIGS. 6A and 6B, in the flowing direction of the humidified air, e.g., as the openings 265*a* are disposed further from the upstream side, e.g., a middle portion in FIGS. 6A and 6B toward the downstream side, in the flowing direction of the humidified air. Therefore, approximately a uniform amount of the humidified air may flow from each opening 265*a* of the recesses 275*a*.

The downstream-side longer section 271 in the feeding direction D may comprise a downstream-side fixed portion 273*b* and a downstream-side flange 274*b*. The downstream-side longer section 271 and the upstream-side longer section 271 may be symmetrically disposed with respect a straight line that extends in the main scanning direction and passes through the center point Q on the nozzle surface 1*a*. The downstream-side fixed portion 273*b* may be fixed to the side surface 1S2 of the head 1. The contact portion 44*a* may be fixed to an outer side surface of the downstream-side fixed portion 273*b*. The downstream-side flange 274*b* may protrude from a lower end of the downstream-side fixed portion 273*b* toward the downstream side in the feeding direction D.

The downstream-side flange 274*b* may have recesses 275*b* formed at an end thereof, e.g., a downstream end in the feeding direction D. The recesses 275*b* may pass through the downstream-side flange 274*b* in the vertical direction. The recesses 275*b* may define, together with the lip member 42, discharge openings, e.g., openings 285*a*, and guide paths 285*b* connected to the openings 285*a*. The openings 285*a* defined by the recesses 275*b* and the lip member 42 may correspond to a discharge opening portion 285. The openings 285*a* of the recesses 275*b* may be disposed equidistantly in the main scanning direction. The two outermost openings 285*a* of the recesses 275*b* may be disposed outside the respective two outermost nozzles 108 on the nozzle surface 1*a*. In other words, the discharge opening portion 285 may have a length longer than the distance between the two outermost nozzles 108. Therefore, effects similar to those of the first embodiment may be obtained.

The downstream-side fixed portion 273*b* may comprise a protruding portion 276*b* protruding upward. The protruding portion 276*b* may be disposed on a central portion of an upper surface of the downstream-side fixed portion 273*b* in the main scanning direction. The downstream-side fixed portion 273*b* may have a flow path 277*b* extending in the vertical direction from a central portion of the downstream-side fixed portion 273*b* in the main scanning direction. The flow path 277*b* may pass through a central portion of the protruding portion 276*b* to communicate with an opening 278*b* formed on a side surface of the downstream-side fixed portion 273*b*. The protruding portion 276*b* may be inserted into the through hole 13*b* of the head holder 13 and connected to the tube 53. A gap or a space may be disposed between protruding portion 276*b* and the through hole 13*b*. The gap may be filled with a sealing material. An end of downstream-side flange 274*b* may contact an inner peripheral surface of the lip member 42. The shorter section 272 may contact the diaphragm 44 on each end thereof in the sub-scanning direction. An end of an area enclosed by the downstream-side longer section 271 and the dividing member 41 in the main scanning direction may be closed to form a flow path 279*b* connected to the flow path 277*b*. As depicted by arrows in FIG. 7, the air in the ejection space S1 may be discharged from the recesses 275*b*, e.g., the openings 285*a*. In the flow path 279*b*, the air suctioned from the recesses 275*b*, via the openings 285*a* and the guide paths 285*b*, may flow in the central portion of the flow path 279*b* toward the opening 278*b*, and discharged to the tank 57, e.g., outside, via the tube 53. The recesses 275*b*, e.g., the openings 285*a* and the guide paths 285*b* and the flow paths 277*b* and 279*b* may correspond to a humidified air discharge passage through which air in the ejection space S1 may be discharged outside.

Areas of the openings 285*a* of the recesses 275*b* may become smaller toward a more downstream side, e.g., a middle portion in FIG. 6B, in a flowing direction of the humidified air, e.g., as the openings 285*a* are disposed further from the upstream side, e.g., right and left directions in FIG. 6B, toward the downstream side, in the flowing direction of the humidified air. Therefore, approximately a uniform amount of the humidified air may flow from each recess 275*b*.

The printer 101 comprising the humidifying mechanism 250 may perform the humidifying operation when the ejection space S1 is enclosed while an image recording operation is or is not performed. The humidified air may be supplied to the ejection space S1 from the recesses 275*a*. In the humidifying operation that may be performed while an image recording operation is performed, the lip member 42 may be positioned in the separation position. In the separation position, an end of the lip member 42 may be positioned slightly lower than the flanges 274*a* and 274*b*. Therefore, the humidified air released from the recesses 275*a* may contact the inner surface of the lip member 42 and may readily stay near the recesses 275*a*. The humidified air may flow effectively in the feeding direction D with the air current associated with the feeding of the sheet P and suctioning from the discharge opening portion 285. Thus, drying of the nozzles 108 may further be reduced. Consequently, even when the head 1 is uncapped, e.g., the ejection space S1 is open, drying of the nozzles 108 may be reduced. Therefore, an amount of ink consumed by the flushing operation may be reduced.

In the humidifying operation that may be performed when the ejection space S1 is enclosed while an image recording operation is not performed, the humidified air may be supplied to the ejection space S1 from the recesses 275*a*. e.g., the supply opening portion 265, similar to the first embodiment. While the air in the ejection space S1 is replaced with the humidified air, the air may flow in the sub-scanning direction toward the discharge opening portion 85. The air in the ejection space S1 may be suctioned by the pump 58, and may flow from the discharge opening portion 285 to the tank 57. The air may be humidified in the lower portion of the tank 57 and may move to the upper portion of the tank 57. The generated humidified air may be supplied to the ejection space S1 while the pump 58 is being driven.

As described above, the humidified air supplied from the supply opening portion 265 may flow in the feeding direction D, e.g., the lateral direction of the head 1, in the humidifying operation, similar to the first embodiment. Therefore, variances in the supply of the humidified air to nozzles 108 may be reduced. Further, because a path for supplying the humidified air is relatively short, variances in the humidity of the humidified air supplied from the supply opening portion 265 to each of the nozzles 108 may be reduced. Thus, variance in the drying of ink in the nozzles 108 may be reduced while an image recording operation is performed, or is not performed when the ejection space S1 is enclosed. The supply opening portion 265 and the discharge opening portion 285 may comprise the recesses 275*a* and 275*b*, respectively and may be simply structured. Effects similar to those of the aforementioned embodiments may be obtained, with respect to the similar structures.

Figure 8:
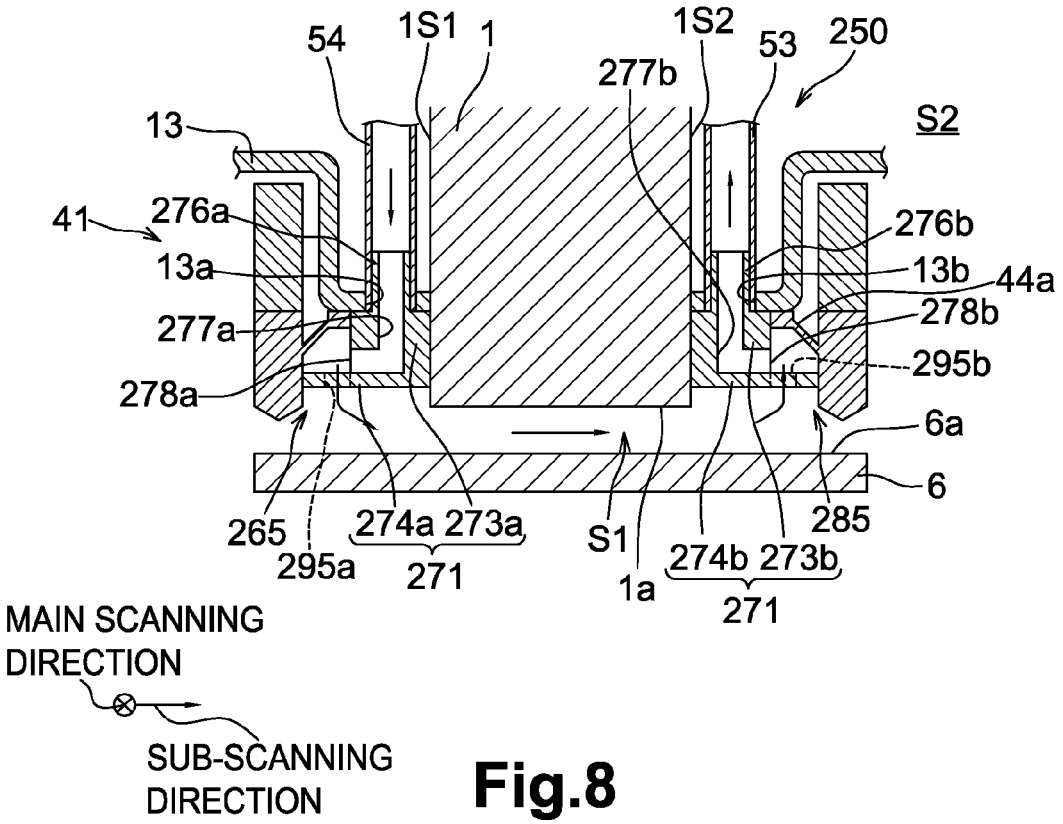
FIG. 8 is a cross-sectional view of a side cover according to another embodiment of the invention.

In yet another embodiment, each flange 274*a* and 274*b* may have a plurality of through holes 295*a* and 295*b*, instead of the recesses 275*a* and 275*b*, respectively, as depicted in FIG. 8. The through holes 295*a* and 295*b* may be disposed closer to the head 1 than the recesses 275*a*, 275*b*. The through holes 295*a*, 295*b* may have opening areas or shapes structured similar to those of the recesses 275*a* and 275*b*, respectively. Therefore, effects similar to the second embodiment may be obtained. The openings of the through holes 295*a* and 295*b* may correspond to the supply opening portion and the discharge opening portion, respectively.

An axis of an opening of each through hole 295*a* and 295*b* may be inclined toward an inner side of the ejection space S1. Therefore, the humidified air may be effectively circulated, and moisture may be supplied uniformly to the nozzles 108.

Figure 14A:
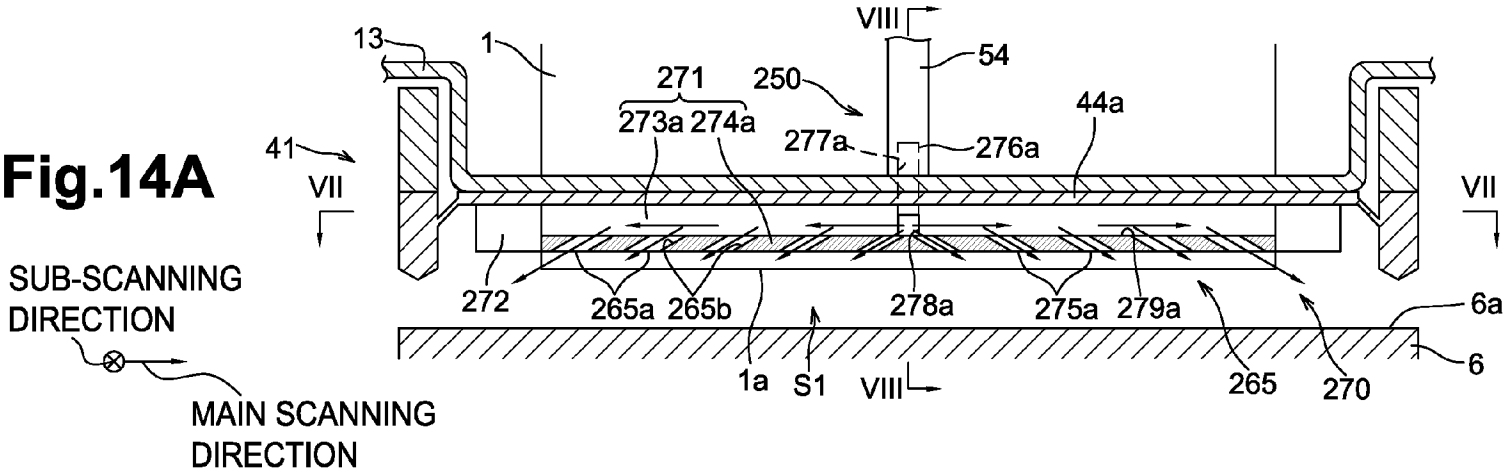
FIG. 14A is a drawing depicting a side cover and a cap mechanism according to another embodiment of the invention.
Figure 14B:
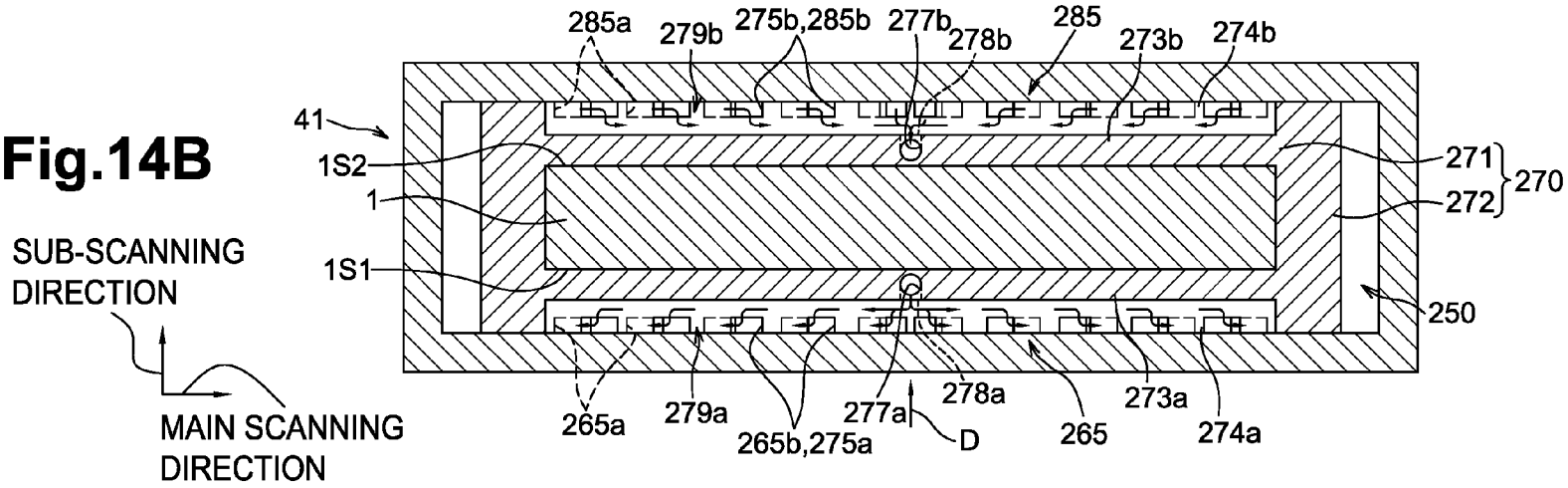
FIG. 14B is a cross-sectional view of the side cover and the cap mechanism taken along a line VII-VII of FIG. 14A.

Another embodiment of the invention, as shown in FIGS. 14A and 14B, the opposing inner side surfaces of the guide paths 265*b* in the main scanning direction may incline outward in the longitudinal direction of the head 1 as the guide paths 265*b* extend downward. Thus, the humidified air may be supplied outwardly from the openings 265*a* to the ejection space S1 in the main scanning direction. Therefore, a greater amount of the humidified air may be supplied to an outer portion of the ejection space S1 than its central portion. The inner surfaces of the outermost recesses 275*a* in the main scanning direction may be inclined such that the humidified air may be supplied toward a contact portion of the platen 6 to the lip member 42, e.g., toward an end of the lip member 42 placed in the contact position. Therefore, when the ejection space S1 is divided or enclosed from the external space S2, moisture may be supplied to ink that may be accumulated in the contact portion between the lip member 42 and the platen 6.

The opposing inner side surfaces of the guide paths 285*b* in the main scanning direction may incline outward in the longitudinal direction of the head 1 as the guide paths 285*b* extend downward.

The printer 101 comprising the humidifying mechanism 250 may perform the humidifying operation both when an image recording operation is performed and when the image recording operation is not performed and the ejection space S1 is enclosed. The humidified air may be supplied to the ejection space S1 from the openings 265*a*. When the humidifying operation is performed during an image recording operation, the lip member 42 may be positioned in the separation position. In the separation position, an end of the lip member 42 may be positioned slightly lower than the flanges 274*a* and 274*b*. Therefore, the humidified air released from the openings 265*a* may contact the inner surface of the lip member 42 and may readily stay near the openings 265*a*. The humidified air may not readily flow toward the upstream side in the feeding direction D. At this time, approximately the same amount of the humidified air may be supplied outward from each opening 265*a* in the main scanning direction. Therefore, a greater amount of the humidified air may stay outward in the main scanning direction. The humidified air may flow effectively in the feeding direction D with the air current associated with the feeding of the sheet P and suctioning from the discharge opening portion 285. Therefore, a greater amount of the humidified air may be supplied to an outer portion of the ejection space S1 than its central portion. Therefore, even when the head 1 is uncapped, e.g., the ejection space S1 is open, drying of the less-frequently used nozzles 108 disposed outward, e.g., on each end portion of the nozzle surface 1*a* in the main scanning direction, may be effectively reduced. Therefore, an amount of ink consumed by the flushing operation may be reduced.

When the humidifying operation is performed with the ejection space S1 be enclosed and an image recording operation is not performed, the humidified air may be supplied to the ejection space S1 from the openings 265*a* of the supply opening portion 265. At this time, the humidified air supplied from the outermost openings 265*a* in the main scanning direction may flow to the contact portion of the platen 6 to the lip member 42. Therefore, when the ejection space S1 is divided or enclosed from the external space S2, moisture may be directly supplied to ink that may be accumulated in the contact portion between the lip member 42 and the platen 6. Therefore, ink near the nozzles 108 may not be readily dried when the ejection space S1 is divided or enclosed. While the air in the ejection space S1 is replaced with the humidified air, the air may flow in the sub-scanning direction toward the discharge opening portion 285. The air in the ejection space S1 may be suctioned by the pump 58, and may flow from the discharge opening portion 285 to the tank 57. The air may be humidified in the lower portion of the tank 57 and may move to the upper portion of the tank 57. The generated humidified air may be supplied to the ejection space S1 while the pump 58 is being driven.

A greater amount of the humidified air may be supplied from the supply opening portion 265 to an outer portion of the ejection space S1 than its central portion in the main scanning direction in the humidifying operation. Therefore, drying of the less-frequently used nozzles 108 disposed outward, e.g., on each end portion of the nozzle surface 1*a* in the main scanning direction, may be effectively reduced. Therefore, discharge of ink by the flushing operation, may be reduced.

The supply opening portion 265 and the discharge opening portion 285 may comprise the recesses 275*a* and 275*b*, e.g., the openings 265*a* and 285*a* and the guide paths 265*b* and 285*b*, respectively. The supply opening portion 265 and the discharge opening portion 285 may be simply structured and formed. Effects similar to those of the aforementioned embodiments may be obtained, with respect to the similar structures.

Referring to FIGS. 9A-10B, in another embodiment, a humidifying mechanism 350 may comprise the humidified air supplying portion and the humidified air discharging portion that may be provided in a side cover 370. The side cover 370 may be configured to surround the outer circumference of the head 1. The side cover 370 may comprise an annular member comprising resin. The side cover 370 may comprise a pair of longer sections 371 extending in the main scanning direction and a pair of shorter sections 372 extending in the sub-scanning direction. The longer section 371 may have the same length as the side surfaces 1S1, 1S2 of the head 1 in the main scanning direction. The shorter sections 372 may connect the longer sections 371.

Figure 9A:
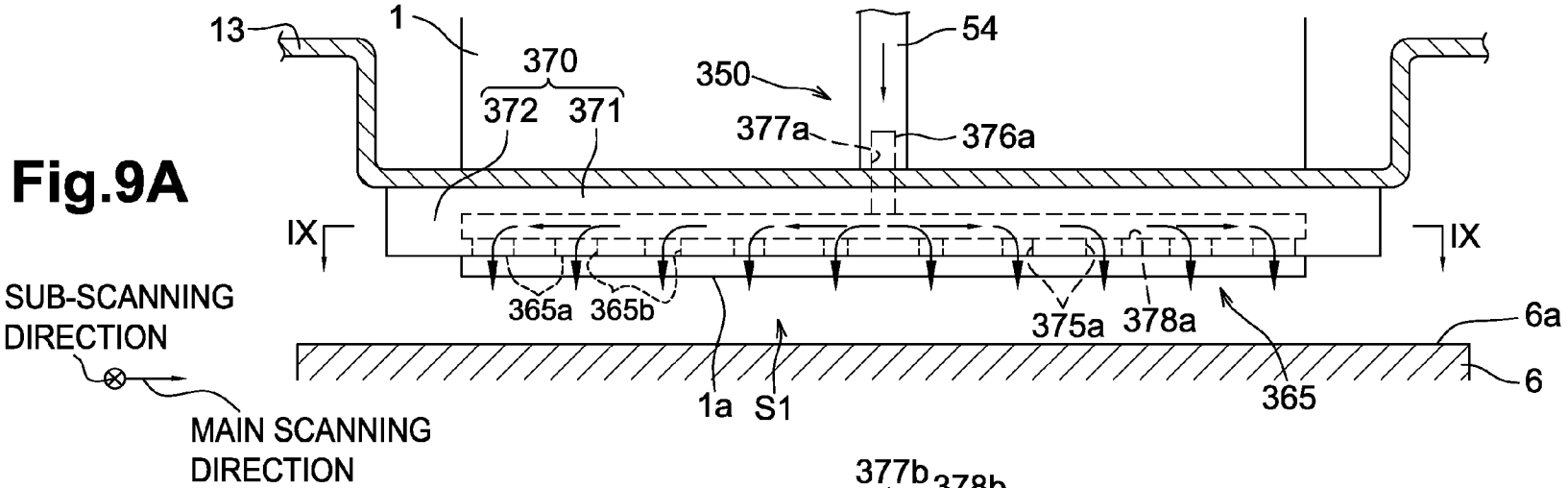
FIG. 9A is a drawing depicting a side cover according to still another embodiment of the invention.
Figure 9B:
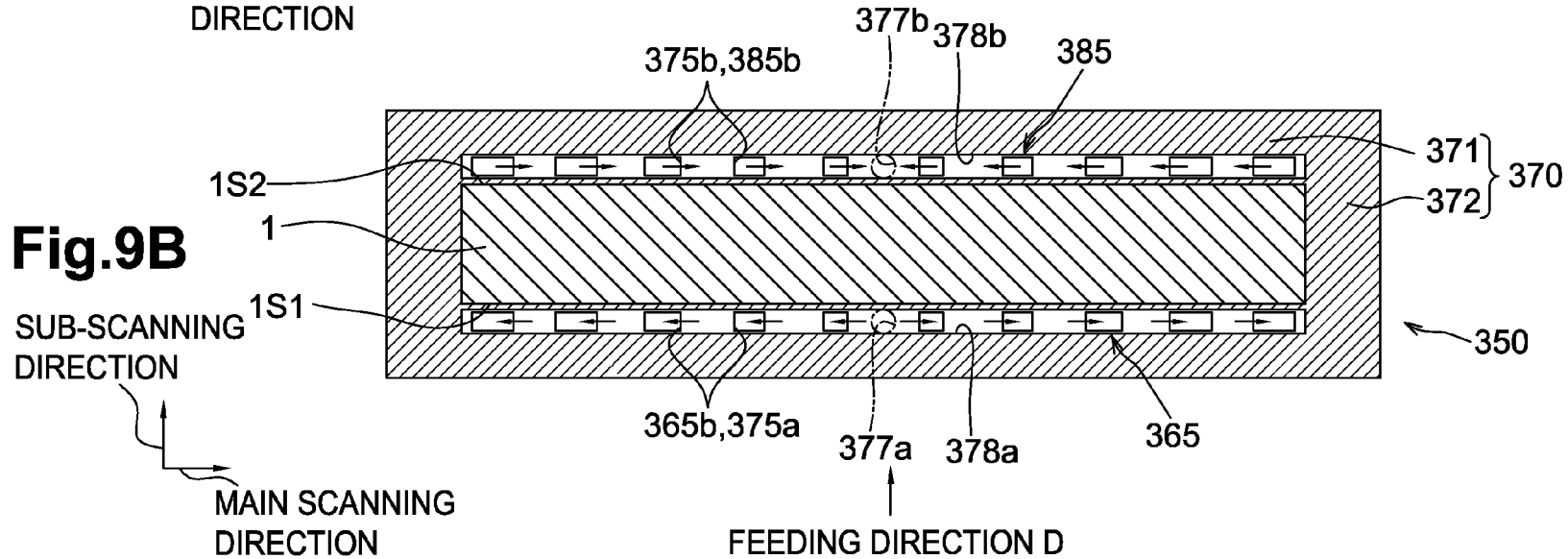
FIG. 9B is a cross-sectional view of the side cover taken along a line IX-IX of FIG. 9A.

The upstream-side longer section 371 in the feeding direction D may be fixed to the side surface 1S1 of the head 1. The upstream-side longer section 371 may comprise a protruding portion 376*a* protruding upward. The protruding portion 376*a* may be disposed on a central portion of an upper surface of the upstream-side longer section 371 in the main scanning direction. The upstream-side longer section 371 may have a flow path 377*a* extending in the vertical direction from a central portion of the upstream-side longer section 371 in the main scanning direction. The upstream-side longer section 371 may have a flow path 378*a* extending in an interior of the upstream-side longer section 371 in the main scanning direction from a central portion thereof in the vertical direction. The flow path 377*a* may pass through a central portion of the protruding portion 376*a* to communicate with the flow path 378*a*. The protruding portion 376*a* may be inserted into the through hole 13*a* of the head holder 13 and connected to the tube 54. A gap or a space may be disposed between the protruding portion 376*a* and the through hole 13*a*. The gap may be filled with a sealing material The upstream-side longer section 371 may have supply slits 375*a* formed on a lower surface thereof. The supply slits 375*a* may communicate with the flow path 378*a*. The supply slits 375*a* may define supply openings e.g., openings 365*a*, and guide paths 365*b* connected to the opening 365*a*. The openings 365*a* of the supply slits 375*a* may constitute a supply opening portion 365. The humidified air may flow in the flow path 377*a* and 378*a*, via the tube 54. As depicted in FIGS. 9A and 9B, the humidified air may flow in the flow path 378*a* from the central portion of FIGS. 9A and 9B toward the right and left directions in FIGS. 9A and 9B, and be supplied to the ejection space S1 from each of the supply slits 375*a*. The supply slits 375*a*, e.g., the openings 365*a* and the guide paths 365*b*, and the flow paths 377*a* and 378*a* may correspond to a humidified air supply passage through which the humidified air may be supplied to the ejection space S1.

The openings 365*a* of the supply slits 375*a* may be disposed equidistantly in the main scanning direction. The two outermost openings 365*a* of supply slits 375*a* may be disposed outside the respective two outermost nozzles 108 on the nozzle surface 1*a*. The supply opening portion 365 may have a length longer than the distance between the two outermost nozzles 108. Thus, effects similar to those of the aforementioned embodiments may be obtained. The lower surface of the side cover 370 may be disposed at a position higher than the nozzle surface 1*a*, so that the side cover 370 may not prevent the feeding of the sheet P.

Figure 10A:
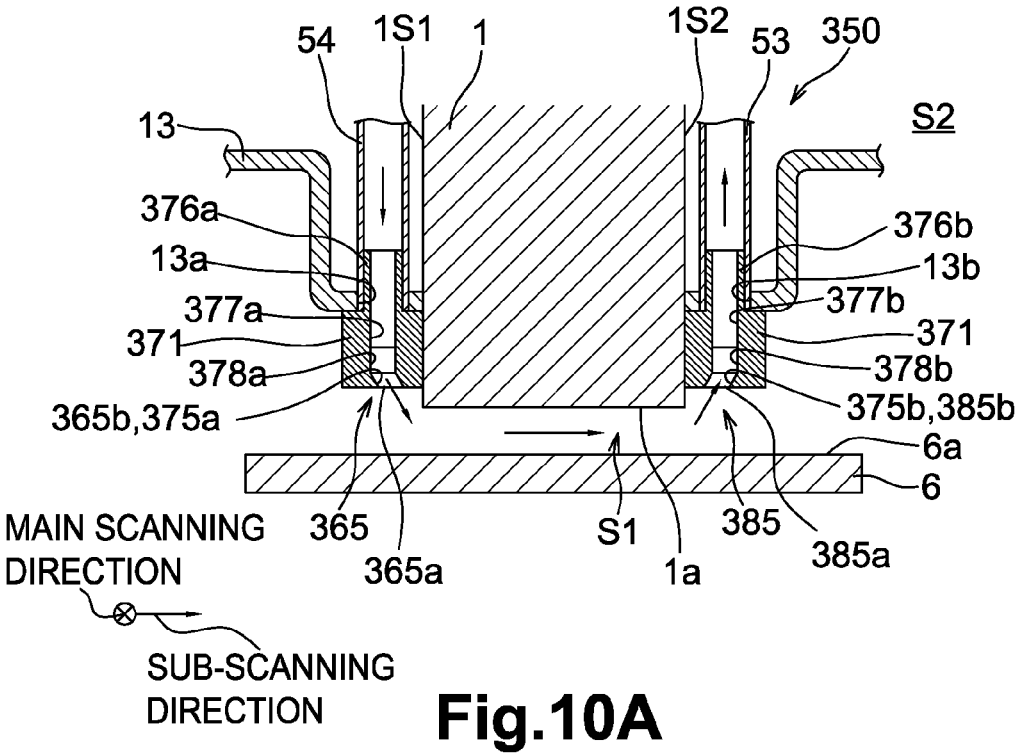
FIG. 10A is a cross-sectional view of an inkjet head during a humidifying operation while an image recording operation is performed according to an embodiment of the invention.

As depicted in FIG. 10A, the guide paths 365*b* of the supply slits 375*a* may incline toward the head 1, e.g., toward the downstream side in the feeding direction D, such that the openings 365*a* may oppose the ejection space S1. Therefore, the humidified air supplied from the openings 365*a* of the supply slits 375*a* may flow effectively toward the downstream side in the feeding direction. Thus, drying of the nozzles 108 may further be reduced.

The resistance of the passage of the flow path 378*a* per unit length to air may become lower toward the downstream side in a flowing direction of the humidified air in the flow path 378*a*, e.g., toward the right and left directions from the central portion of FIGS. 9A and 9B. As depicted in FIG. 9B, areas of the openings 365*a* of the supply slits 375*a* may become greater as the supply slits 375*a* are disposed on the more downstream-side, e.g., the right and left directions in FIGS. 9A and 9B. Therefore, approximately the same amount of the humidified air may flow out from each of the supply slits 375*a*.

The downstream-side longer section 371 and the upstream-side longer section 371 may be symmetrically disposed with respect a straight line that extends in the main scanning direction and passes through the center point Q on the nozzle surface 1*a*. The downstream-side longer section 371 may be fixed to the side surface 1S2 of the head 1. The downstream-side longer section 371 may comprise a protruding portion 376*b*. The downstream-side longer section 371 may comprise a flow path 377*b* extending in the vertical direction from a central portion of the downstream-side longer section 371 in the main scanning direction and a flow path 378*b* extending in the main scanning direction from a central portion of the downstream-side longer section 371 in the vertical direction. The flow path 378*b* may communicate with the flow path 377*b*. The protruding portion 376*a* may be inserted into the through hole 13*b* of the head holder 13 and connected to the tube 53. A gap or a space may be disposed between the protruding portion 376*b* and the through hole 13*b*. The gap may be filled with a sealing material.

The downstream-side longer section 371 may have discharge slits 375*b* formed on a lower surface thereof. The discharge slits 375*b* may communicate with the flow path 378*b*. The discharge slits 375*b* may define discharge openings, e.g., openings 385*a*, and guide paths 385*b* connected to the openings 385*a*. The openings 385*a* of the discharge slits 375*b* may constitute a discharge opening portion 385. The discharge slits 375*b* may be arranged in the main scanning direction. The air in the ejection space S1 may be discharged from each of the discharge slits 375*b*. The discharge slits 375*b*, e.g., the openings 385*a* and the guide paths 385*b*, and the flow paths 377*b* and 378*b* may correspond to a humidified air discharge passage through which air in the ejection space S1 may be discharged outside.

As depicted in FIG. 9B, the two outermost openings 385*a* of the discharge slits 375*b* with respect to the main scanning direction may be disposed outside the respective two outermost nozzles 108 on the nozzle surface 1*a*. The discharge opening portion 385 may have a length longer than the distance between the two outermost nozzles 108. Therefore, the humidified air supplied from the supply opening portion 365 may easily flow in a direction parallel to the sub-scanning direction, e.g., the feeding direction D. Variances in the supply of the humidified air to all nozzles 108 may be reduced.

As depicted in FIG. 10A, the guide paths 385*b* of the discharge slits 375*b* may incline toward the head 1, e.g., toward the upstream side in the feeding direction D, such that the openings 385*b* may oppose the ejection space S1. Therefore, the air in the ejection space S1 may be readily discharged.

The resistance of the passage of the flow path 378*b* per unit length to air may become greater toward the downstream side in a flowing direction of the humidified air in the flow path 378*b*, e.g., from the right and left directions toward the central portion of FIG. 9B. Areas of the openings 385*a* of the discharge slits 375*b* may become smaller toward a more downstream-side, e.g., the central portion in FIG. 9B. Therefore, approximately the same amount of the air may flow in from each of the discharge slits 375*b*.

Figure 10B:
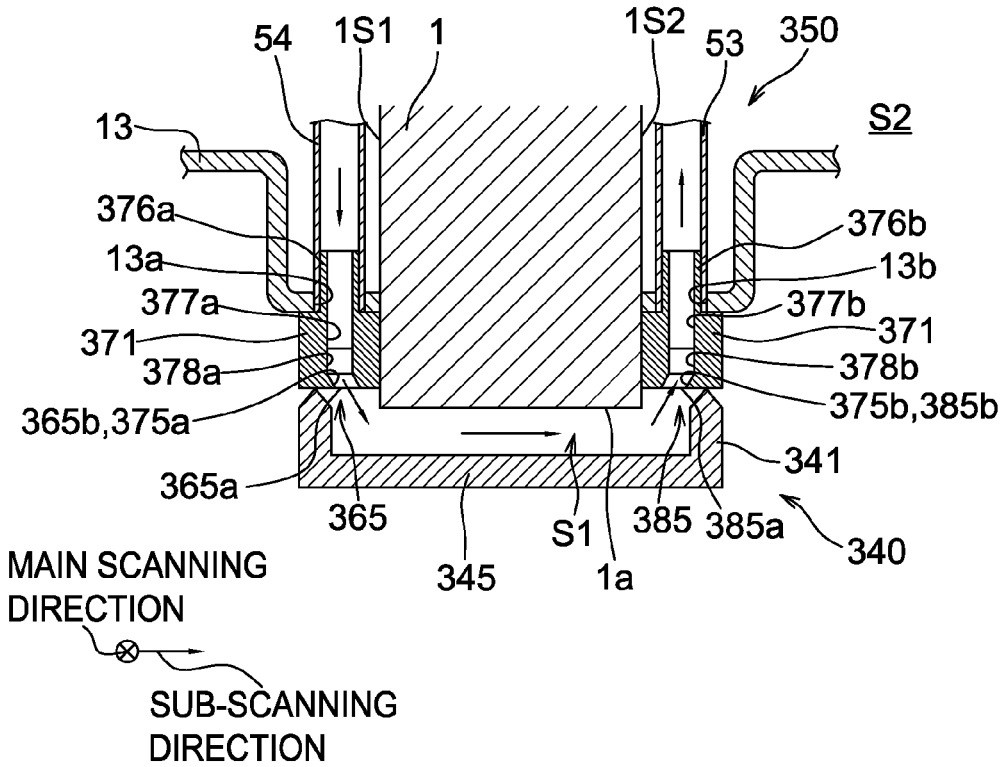
FIG. 10B is a cross-sectional view of an inkjet head during a humidifying operation is performed while an image recording operation is not performed according to an embodiment of the invention.

As depicted in FIG. 10B, a capping mechanism 340 may comprise a dividing member 341, an opposing member 345, and a movement mechanism configured to move the opposing member 345. The opposing member 345 may be a flat plate having a rectangular shape in plan view. An outer size of the opposing member 345 may be approximately the same as the size of the side cover 370. The dividing member 341 may comprise an annular-shaped elastic material, e.g., rubber. The dividing member 341 may integrally formed with the opposing member 345 and protrude from peripheral ends of the opposing member 345.

The movement mechanism may be configured to move the opposing member 345 under the control of the control device 100, e.g., controller. An end of the dividing member 341 may change in the vertical direction relative to the side cover 370. The dividing member 341 may selectively move between a contact position, as depicted in FIG. 10B, where the end of the dividing member 341 may contact a peripheral end of the lower surface of the side cover 370, and a separation position where the end of the dividing member 341 may separate from the side cover 370, in association with the movement of the opposing member 345. When the dividing member 341 contacts the side cover 370, the dividing member 341, the opposing member 345, and the nozzle surface 1*a* may divide or enclose the ejection space S1 from the external space S2. When the dividing member 341 separates from the side cover 370, the ejection space S1 may be open to the external space S2.

The printer 101 comprising humidifying mechanism 350 and the capping mechanism 340 may perform the humidifying operation both when an image recording operation is performed and when an image recording operation is not performed and the ejection space S1 is enclosed.

When the capping operation is performed, the dividing member 341 may be placed in the contact position, as depicted in FIG. 10B, under the control of the control device 100. The ejection space S1 may be divided or enclosed from the external space S2. Consequently, a path for the humidified air may be formed in the lateral direction of the head 1, e.g., the sub-scanning direction, in the dividing member 341.

When the humidifying operation is performed and the ejection space S1 is closed, e.g., when an image recording operation is not performed, the humidified air may be supplied to the ejection space S1 from the openings 365*a* of the supply opening portion 365 under the control of the control device 100. While the air in the ejection space S1 is replaced with the humidified air, the air may flow in the sub-scanning direction toward the openings 385*a* of the discharge opening portion 385. The air in the ejection space S1 may be suctioned by the pump 58, and may flow from the discharge opening portion 385 to the tank 57. The air may be humidified in the lower portion of the tank 57 and may move to the upper portion of the tank 57. The generated humidified air may be supplied to the ejection space S1 while the pump 58 is being driven.

When the uncapping operation is performed, the dividing member 341 may be placed in the separation position under the control of the control device 100. As depicted in FIG. 10A, the dividing member 341 may open the ejection space S1 to the external space S2.

When the humidifying operation is performed while an image recording operation is performed, the air may flow, similar to the humidifying operation that may be performed when the ejection space S1 is enclosed while an image recording operation is not performed. The humidified air may be supplied from the openings 365*a* of the supply slits 375*a* of the supply opening portion 365 to the ejection space S1 and to the nozzles 108. The humidified air may move from the openings 365*a* of the supply slits 375*a* to the nozzles 108. Therefore, even when the head 1 is uncapped, e.g., the ejection space S1 is open, drying of the nozzles 108 may be reduced. Therefore, an amount of ink consumed by the flushing operation may be reduced.

As described above, the humidified air supplied from the supply opening portion 365 may flow in the feeding direction D, e.g., the lateral direction of the head 1, in the humidifying operation. Therefore, variances in the supply of the humidified air to nozzles 108 may be reduced, similar to the first and second embodiments. Further, because a path for supplying the humidified air is relatively short, variances in the humidity of the humidified air supplied from the supply opening portion 365 to each of the nozzles 108 may be reduced. Thus, variances in the drying of ink in the nozzles 108 may be reduced both when an image recording operation is performed and when an image recording operation is not performed and the ejection space S1 is closed.

Figure 15A:
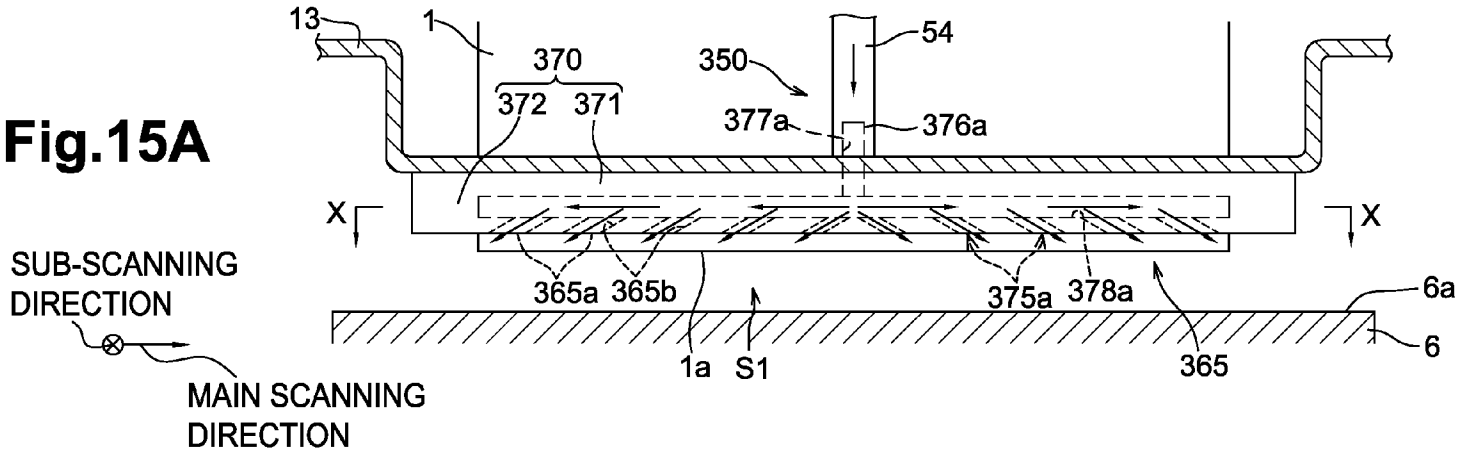
FIG. 15A is a cross-sectional view of a side cover according to still another embodiment of the invention.
Figure 15B:
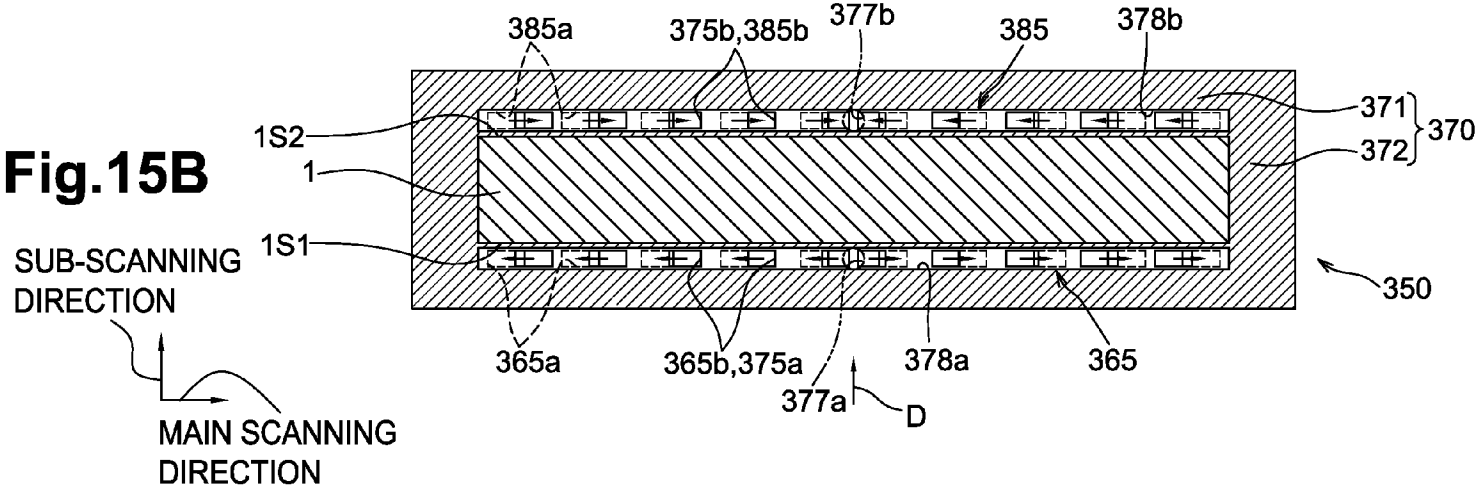
FIG. 15B is a cross-sectional view of the side cover taken along a line X-X of FIG. 15A.

Referring to FIGS. 15A and 15B, in another embodiment of the invention, the opposing inner side surfaces of the guide paths 365*b* in the main scanning direction may incline outward in the longitudinal direction of the head 1 as the guide paths 365*b* extend downward.

Therefore, the humidified air may be supplied from the openings 365*a* outwardly to the ejection space S1 in the main scanning direction. Therefore, a greater amount of the humidified air may be supplied to an outer portion of the ejection space S1 than its central portion.

The opposing inner side surfaces of the guide paths 385*b* in the main scanning direction may incline outward in the longitudinal direction of the head 1 as the guide paths 385*b* extend downward.

Approximately the same amount of the humidified air may be supplied outward in the main scanning direction from each opening 365*a*. Therefore, a greater amount of the humidified air may be supplied to an outer portion of the ejection space S1 than its central portion in the main scanning direction. Therefore, drying of the less-frequently used nozzles 108 that may be disposed outward, e.g., on each end portion of the nozzle surface 1*a* in the main scanning direction, may be effectively reduced. Consequently, an amount of ink consumed by the flushing operation may be reduced.

The humidifying operation may be performed while an image recording operation is performed. In the humidifying operation that may be performed while an image recording operation is performed, the humidified air supplied from the supply opening portion 365 may flow in the feeding direction D, e.g., the lateral direction of the head 1, in association with the feeding of the sheet P. The humidified air may flow thorough the ejection space S1 to the discharge opening portion 85. Therefore, during the image recording operation when the ejection space S1 is open, drying of the nozzles 108 may be reduced. A greater amount of the humidified air may be supplied from the supply opening portion 365 to an outer portion of the ejection space S1 than its central portion in the main scanning direction. Therefore, drying of the less-frequently used nozzles 108 that may be disposed outward, e.g., on each end portion of the nozzle surface 1*a* in the main scanning direction, may be reduced. Consequently, discharge of ink by the flushing operation may be reduced.

While the disclosure has been described in detail with reference to the specific embodiment thereof, this is merely an example, and various changes, arrangements and modifications may be applied therein without departing from the spirit and scope of the disclosure.

The first supply pipe 61 may be connected to a central portion of the second supply pipe 63, and the first discharge pipe 81 may be connected to a central portion of the second discharge pipe 83. In another embodiment, the protruding portion 276*a* and 276*b*, and 376*a* and 376*b* may be connected to an end of the upper surface of the longer section 271 and 371, respectively.

The air in the ejection space S1 may be forcibly suctioned from the discharge opening portion 85, 285, and 385. The air in the ejection space S1 may be naturally discharged from the discharge opening portion 85, 285, and 385 that may be directly connected or communicate to the outside, e.g., the external space S2. The supply opening portion 65, 265, and 365 and the discharge opening portion 85, 285, and 385 may have a length shorter than the distance between the two outermost nozzles 108 in the main scanning direction. The supply opening portion 65, 265, and 365 and the discharge opening portion 85, 285, and 385 may comprise one opening extending in the main scanning direction. In the above embodiments, the humidifying operation may be performed while an image recording operation is performed. Alternatively, the humidifying operation may be performed when an image recording operation is not performed, as long as the ejection space S1 is open to the external space S2. More specifically, the humidifying operation may be performed, e.g., during a waiting time until an image recording operation is performed after the divided or enclosed ejection space S1 becomes open to the external space S2 or a waiting time until the ejection space S1 is divided or enclosed after an image recording operation is finished.

In the above embodiments, the passage of the humidified air may be provided separately from the head body 3. Alternatively, the passage of the humidified air may be provided in the head body 3 separately from the ink flow path in the head body 3. For example, the passage for the humidified air, e.g., the supply opening portion 365 and the discharge opening portion 385, may open or be provided in the side cover 370, e.g., the longer section 371, in the third embodiment. Alternatively, the passage for the humidified air may open or be provided on a periphery of the nozzle surface 1*a*. Supply and discharge openings for the humidified air may interpose all nozzles 108 on the nozzle surface 1*a* therebetween in the sub-scanning direction. In this case, the number of components may be reduced and a structure of the printer 101 may be simplified. Consequently, the size of the printer 101 may be reduced. The supply opening and discharge opening portions may be disposed closer to the nozzles 108. This structure may contribute to efficient supply of the humidified air.

The pump 58 may be disposed in a return portion of the circulation passage of the humidified air with respect to the tank 57. Supply of the humidified air to the ejection space S1 may be performed by the force of the pump 58 suctioning the air from the ejection space S1. Alternatively, the pump 58 may be disposed in an outward portion of the circulation passage of the humidified air with respect to the tank 57. Supply of the humidified air to the ejection space S1 may be performed by the force of the pump 58 sending the humidified air to the ejection space S1.

The invention may be applied to a line-type and serial type liquid ejection apparatus. The invention may be applied not only printers but also, for example, facsimile machines and copiers. Further, the invention may be applied to liquid ejection apparatus configured to perform recording by ejecting liquid other than ink. The recording mediums may not be limited to the sheets P but may be various types of recordable mediums. The invention may be applied regardless of the liquid ejection method. For example, the piezoelectric element may be used as a method to eject liquid in the embodiments. Alternatively, resistance heating or capacitance may be used.

Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A liquid ejection apparatus comprising:

a feeding mechanism configured to feed a recording medium in a first direction;

a head comprising a nozzle surface in which nozzles are disposed, wherein the head is configured to eject liquid through the nozzles; and a humidifying mechanism comprising:

a humidified air generating device configured to generate humidified air;

an output portion connected to the humidified air generating device, wherein the output portion comprises a first supplying channel with a first opening and a second opening formed therein, wherein an area of the second opening is greater than an area of the first opening, wherein the first opening is separated from the second opening in a second direction perpendicular to the first direction, and wherein the output portion is configured to output the humidified air generated by the humidified air generating device through the first opening and the second opening; and a receiving portion configured to receive the humidified air output from the output portion, wherein the head is disposed between the output portion and the receiving portion in the first direction, wherein the output portion comprises a second supplying channel connecting the humidified air generating device to the output portion and configured to supply humidified air to the first and the second openings of the output portion via the first supplying channel, wherein the first supplying channel comprises a plurality of openings through which the humidified air generated by the humidified air generating device is output, the plurality of openings including the first opening and the second opening, wherein the output portion permits the humidified air generated by the humidified air generating device to be output only through the plurality of openings corresponding to the output portion, wherein, for each respective opening of the plurality of openings except each opening adjacent to the second supply channel, an area of such respective opening is greater than an area of an adjacent opening of the plurality of openings that is disposed closer than such respective opening to the second supplying channel in the second direction, and wherein the first supplying channel is substantially parallel to the nozzle surface of the head and an entirety of the first supplying channel is disposed further than the nozzle surface from the feeding mechanism in a third direction perpendicular to the first direction and the second direction, such that the first supplying channel is configured to not interfere with conveyance of the recording medium by the feeding mechanism.

2. The liquid ejection apparatus of claim 1, wherein each of the nozzles of the head is disposed between at least two openings of the output portion in the second direction.

3. The liquid ejection apparatus of claim 1, wherein the first opening is disposed closer to the second supplying channel in the second direction than the second opening is disposed to the second supplying channel in the second direction.

4. The liquid ejection apparatus of claim 3, wherein the second supplying channel is disposed at a center portion of the output portion in the second direction.

5. The liquid ejection apparatus of claim 3, wherein the second supplying channel is disposed at an end portion of the output portion in the second direction.

6. The liquid ejection apparatus of claim 1, wherein the receiving portion comprises a first discharging channel with a third opening and a fourth opening formed therein, wherein an area of the fourth opening is greater than an area of the third opening, wherein the receiving portion is configured to receive the humidified air output from the output portion through the third opening and the fourth opening, and wherein the first discharging channel is substantially parallel to the nozzle surface of the head and an entirety of the first discharging channel is disposed further than the nozzle surface from the feeding mechanism in the third direction, such that the first discharging channel is configured to not interfere with conveyance of the recording medium by the feeding mechanism.

7. The liquid ejection apparatus of claim 6, wherein the receiving portion further comprises a second discharging channel configured to receive humidified air from the third and fourth openings of the receiving portion via the first discharging channel, and wherein the third opening is disposed closer to the second discharging channel than the fourth opening is disposed to the second discharging channel.

8. The liquid ejection apparatus of claim 7, wherein the discharging channel is disposed at a center portion of the receiving portion in the second direction.

9. The liquid ejection apparatus of claim 7, wherein the discharge channel is disposed at an end portion of the receiving portion in the second direction.

10. The liquid ejection apparatus of claim 1, wherein each of the nozzles of the head is disposed between at least two openings of the receiving portion in the second direction.

11. The liquid ejection apparatus of claim 1 further comprising:

a capping mechanism comprising a cover configured to cover a portion of the nozzle surface in which the nozzles are disposed, such that an enclosed space is formed between the cover and the nozzle surface when the cover covers the portion of the nozzle surface.

12. The liquid ejection apparatus of claim 11, wherein the cover comprises:

an opposing member configured to face the nozzle surface; and a dividing member configured to surround the portion of the nozzle surface when the cover covers the portion of the nozzle surface.

13. The liquid ejection apparatus of claim 11, wherein the cover is configured to cover the output portion and the receiving portion when the cover covers the portion of the nozzle surface.

14. The liquid ejection apparatus of claim 11 further comprising:

a controller configured to control the humidifying mechanism such that the humidifying mechanism performs a humidifying operation when the nozzle surface is not covered by the cover and the head eject liquid and when the nozzle surface is covered by the cover.

15. The liquid ejection apparatus of claim 11 further comprising:

a controller configured to control the humidifying mechanism such that the humidifying mechanism performs a humidifying operation when the nozzle surface is not covered by the cover and the head is ejecting liquid and when the nozzle surface is covered by the cover.

16. The liquid ejection apparatus of claim 15, wherein the controller is configured to control the humidifying mechanism such that flow amount of the humidified air output from the output portion per unit time when the nozzle surface is not covered by the cover and the nozzles eject liquid, is greater than flow amount of the humidified air output from the output portion per unit time when the nozzle surface is covered by the cover.

17. The liquid ejection apparatus of claim 15, wherein the output portion is disposed at an upstream side surface of the head in the feeding direction and the receiving portion is disposed at a downstream side surface of the head in the feeding direction.

18. The liquid ejection apparatus of claim 1, wherein a length of the head in the second direction is greater than a length of the head in the first direction.

19. The liquid ejection apparatus of claim 1, wherein the output portion is disposed upstream from the head in the first direction.

20. The liquid ejection apparatus of claim 1, wherein the nozzles of the head are arranged in a row extending in the second direction.

21. The liquid ejection apparatus of claim 1, wherein the first opening of the output portion faces toward a portion of the feeding mechanism opposite from the head and inclined toward the nozzle surface of the head.

22. The liquid ejection apparatus of claim 1, wherein the output portion is disposed at an upstream side surface of the head in the first direction, and wherein the receiving portion is disposed at a downstream side surface of the head in the first direction.

23. The liquid ejection apparatus of claim 1, wherein a first pair of adjacent openings of the output portion including the first opening and the second opening are disposed closer to a center portion of the output portion than a second pair of adjacent openings of the output portion including a third opening and a fourth opening, wherein an area of the fourth opening is greater than an area of the third opening, wherein the area of the third opening is greater than the area of the second opening, and wherein a distance in the second direction between the first pair of adjacent openings is greater than a distance in the second direction between the second pair of adjacent openings.

24. The liquid ejection apparatus of claim 1, wherein each of the first opening and the second opening of the output portion is formed as a through hole through a plate in the first supplying channel, such that each respective through hole is inclined toward a center portion of the output portion in the second direction.

25. The liquid ejection apparatus of claim 1, wherein the plurality of openings face in a direction toward a portion of the feeding mechanism and are inclined toward the nozzle surface of the head.

26. The liquid ejection apparatus of claim 1 further comprising:

a receiving portion disposed at a downstream side surface of the head in the feeding direction, wherein the receiving portion is configured to receive humidified air output from the output portion, wherein the output portion is disposed at an upstream side surface of the head in the feeding direction.

27. The liquid ejection apparatus of claim 1, wherein each of the plurality of openings supplies a same flow amount of the humidified air.

* * * * *